US005848173A

United States Patent [19]

Sato et al.

[11] Patent Number: 5,848,173

[45] Date of Patent: Dec. 8, 1998

[54] SURROUNDLESS LOUDSPEAKER

[75] Inventors: Yoko Sato; Satoshi Kumada; Ziging Zhang; Junko Oba; Shinji Koyano; Takashi Morishige; Kohshiro Kogure; Yuichi Mohri; Tomohiro Suenaga; Shouichiro Terauchi; Tatsuya Ando; Takanobu Saito; Takashi Ohyaba; Shunichi Takahashi; Teruo Baba, all of Saitama-ken, Japan

[73] Assignee: Pioneer Electronic Corporation, Tokyo, Japan

[21] Appl. No.: 623,381

[22] Filed: Mar. 28, 1996

[30] Foreign Application Priority Data

| | | | |
|---|---|---|---|
| Mar. 30, 1995 | [JP] | Japan | 7-097943 |
| Jul. 21, 1995 | [JP] | Japan | 7-185689 |
| Sep. 11, 1995 | [JP] | Japan | 7-233032 |
| Sep. 11, 1995 | [JP] | Japan | 7-233033 |
| Sep. 11, 1995 | [JP] | Japan | 7-233034 |
| Sep. 11, 1995 | [JP] | Japan | 7-233035 |
| Sep. 29, 1995 | [JP] | Japan | 7-254116 |
| Sep. 29, 1995 | [JP] | Japan | 7-254117 |
| Oct. 6, 1995 | [JP] | Japan | 7-260363 |

[51] Int. Cl.[6] ..... H04R 25/00

[52] U.S. Cl. ..... 381/398; 381/403; 381/345; 181/171

[58] Field of Search ..... 381/192, 193, 381/194, 195, 196, 197, 199, 202, 201, 203, 345, 396, 397, 398, 403, 404, 423, 424; 181/171, 172

[56] References Cited

U.S. PATENT DOCUMENTS

| | | | |
|---|---|---|---|
| 3,925,626 | 12/1975 | Stallings, Jr. | 381/194 |
| 4,235,302 | 11/1980 | Tsukamoto | 181/172 |
| 4,384,174 | 5/1983 | Suzuki et al. | 381/204 |
| 4,427,845 | 1/1984 | Yoshida et al. | 381/195 |
| 4,609,784 | 9/1986 | Miller | 381/96 |

FOREIGN PATENT DOCUMENTS

| | | | |
|---|---|---|---|
| 0968234 | 11/1950 | France | 381/195 |
| 2029669 | 3/1980 | United Kingdom | 381/195 |

*Primary Examiner*—Huyen Le

*Attorney, Agent, or Firm*—Nikaido, Marmelstein, Murray & Oram LLP

[57] ABSTRACT

A cylindrical frame is mounted in a cabinet and a magnetic circuit is provided at an end of the frame. A diaphragm having a peripheral free edge is connected to a coil bobbin and a cylindrical ring is secured to the free end edge and disposed in a cylindrical supporting portion of the frame. An annular sealing member is secured to the cylindrical ring so that an outside peripheral wall thereof is slidably contacted with an inside wall of the cylindrical supporting portion of the frame.

31 Claims, 47 Drawing Sheets

FIG.14

SHORT VOICE COIL STROKE ±20mm

| EFFECTIVE LENGTH | TOTAL COIL LENGTH | PLATE THICKNESS | EFFECTIVE WIRE LENGTH | TOTAL WIRE LENGTH | EFFECTIVE WELGHT | TOTAL WELGHT | MAGNETIC FLUX DENSITY | FORCE FACTOR | CONVERSION EFFICIENCY |
|---|---|---|---|---|---|---|---|---|---|
| 1.00 | 1.000 | 41.00 | 1.7092 | 1.7092 | 0.10109306 | 0.10109306 | 0.82052 | 1.4025 | 0.07002862 |
| 3.00 | 3.000 | 43.00 | 3.5553 | 3.5553 | 0.43740426 | 0.43740426 | 0.78583 | 2.7939 | 0.25335329 |
| 5.00 | 5.000 | 45.00 | 4.9978 | 4.9978 | 0.86433349 | 0.86433349 | 0.75419 | 3.7693 | 0.41241823 |
| 7.00 | 7.000 | 47.00 | 6.2546 | 6.2546 | 1.35368845 | 1.35368845 | 0.72499 | 4.5345 | 0.52898894 |
| 9.00 | 9.000 | 49.00 | 7.3954 | 7.3954 | 1.89253832 | 1.89253832 | 0.69797 | 5.1617 | 0.60490134 |
| 11.00 | 11.000 | 51.00 | 8.4540 | 8.4540 | 2.47311844 | 2.47311844 | 0.67289 | 5.6886 | 0.64738821 |
| 13.00 | 13.000 | 53.00 | 9.4499 | 9.4499 | 3.09014699 | 3.09014699 | 0.64955 | 6.1381 | 0.66439542 |
| 15.00 | 15.000 | 55.00 | 10.3958 | 10.3958 | 3.73975382 | 3.73975382 | 0.62777 | 6.5262 | 0.66294759 |
| 17.00 | 17.000 | 57.00 | 11.3005 | 11.3005 | 4.41895824 | 4.41895824 | 0.60741 | 6.8640 | 0.64871035 |
| 19.00 | 19.000 | 59.00 | 12.1703 | 12.1703 | 5.12538079 | 5.12538079 | 0.58832 | 7.1601 | 0.62602643 |

FIG.15

DOUBLE VOICE COIL STROKE ±20mm

| EFFECTIVE LENGTH | TOTAL COIL LENGTH | PLANE THICKNESS | EFFECTIVE WIRE LENGTH | TOTAL WIRE LENGTH | EFFECTIVE WELGHT | TOTAL WELGHT | FLUX DENSITY MAGNETIC | FORCE FACTOR | CONVERSION EFFICIENCY |
|---|---|---|---|---|---|---|---|---|---|
| 1.00 | 2 | 20.50 | 1.3566 | 2.7132 | 0.25473854 | 0.10109306 | 1.48861 | 2.0195 | 0.13911626 |
| 3.00 | 6 | 21.50 | 2.8219 | 5.6437 | 1.10218967 | 0.43740426 | 1.43171 | 4.0401 | 0.44639874 |
| 5.00 | 10 | 22.50 | 3.9668 | 7.9335 | 2.17798392 | 0.86433349 | 1.37899 | 5.4701 | 0.63774410 |
| 7.00 | 14 | 23.50 | 4.9643 | 9.9285 | 3.41108114 | 1.35368845 | 1.33002 | 6.6026 | 0.72207122 |
| 9.00 | 18 | 24.50 | 5.8697 | 11.7394 | 4.76889773 | 1.89253832 | 1.28441 | 7.5391 | 0.73674205 |
| 11.00 | 22 | 25.50 | 6.7099 | 13.4198 | 6.23186796 | 2.47311844 | 1.24182 | 8.3325 | 0.71196147 |
| 13.00 | 26 | 26.50 | 7.5004 | 15.0008 | 7.78668249 | 3.09014699 | 1.20197 | 9.0152 | 0.66735749 |
| 15.00 | 30 | 27.50 | 8.2514 | 16.5024 | 9.42358911 | 3.73975382 | 1.16459 | 9.6093 | 0.61459619 |
| 17.00 | 34 | 28.50 | 8.9692 | 17.9385 | 11.13507701 | 4.41895824 | 1.12947 | 10.1305 | 0.56023010 |
| 19.00 | 38 | 29.50 | 9.6596 | 19.3192 | 12.91515029 | 5.12538079 | 1.09640 | 10.5908 | 0.50773486 |

FIG.16

LONG VOICE COIL STROKE ±20mm

| EFFECTIVE LENGTH | TOTAL COIL LENGTH | PLATE THICKNESS | EFFECTIVE WIRE LENGTH | TOTAL WIRE LENGTH | EFFECTIVE WELGHT | TOTAL WELGHT | MAGNETIC FLUX DENSITY | FORCE FACTOR | CONVERSION EFFICIENCY |
|---|---|---|---|---|---|---|---|---|---|
| 1.00 | 41.000 | 1.00 | 0.4957 | 20.3230 | 0.34859083 | 14.29222390 | 6.61798 | 3.2804 | 0.00389201 |
| 3.00 | 43.000 | 3.00 | 1.4639 | 20.9787 | 1.06250767 | 15.22927666 | 4.88986 | 7.1569 | 0.03113297 |
| 5.00 | 45.000 | 5.00 | 2.4027 | 21.6242 | 1.79788611 | 16.18097501 | 3.87738 | 9.3161 | 0.07715074 |
| 7.00 | 47.000 | 7.00 | 3.3154 | 22.2603 | 2.55379086 | 17.14688148 | 3.21226 | 10.6498 | 0.13537773 |
| 9.00 | 49.000 | 9.00 | 4.2038 | 22.8874 | 3.32937365 | 18.12658988 | 2.74191 | 11.5265 | 0.20101371 |
| 11.00 | 51.000 | 11.00 | 5.0699 | 23.5060 | 4.12386158 | 19.11972187 | 2.39171 | 12.1258 | 0.27056606 |
| 13.00 | 53.000 | 13.00 | 5.9154 | 24.1166 | 4.93654740 | 20.12592400 | 2.12084 | 12.5456 | 0.34151165 |
| 15.00 | 55.000 | 15.00 | 6.7417 | 24.7196 | 5.76678143 | 21.14486523 | 1.90508 | 12.8435 | 0.37386324 |
| 17.00 | 57.000 | 17.00 | 7.5502 | 25.3153 | 6.61396474 | 22.17623473 | 1.72916 | 13.0555 | 0.35947875 |
| 19.00 | 59.000 | 19.00 | 8.3420 | 25.9040 | 7.47754337 | 23.21973992 | 1.58299 | 13.2053 | 0.34281471 |

SURROUNDLESS LOUDSPEAKER

BACKGROUND OF THE INVENTION

The present invention relates to a surroundless loudspeaker where an annular surround usually provided between an outer periphery of a diaphragm and an inner periphery of a frame of the speaker is removed Referring to FIG. 63, a conventional dynamic cone loudspeaker has a cylindrical bobbin 5 around which a voice coil (not shown) is attached. The bobbin 5 is supported by a frame 7 through a damper 6*a*. On the upper periphery of the bobbin 5 are attached a conical diaphragm 8 and a center cap 9. The diaphragm 8 is secured to the frame 7 around an upper edge thereof through a surround 15.

The surround 15 is provided not only for supporting the diaphragm 8, but also for preventing the air from flowing in and out of a speaker cabinet. The surround is made of a flexible material so as to allow the diaphragm to move in the axial direction thereof with ease, and at the same time, maintains the diaphragm in its position at the axial center.

However, due to the very flexibility of the material, the surround may cause resonance at certain frequencies. Moreover, when the diaphragm 8 and the bobbin 5 are moved a large distance, the pressure in the cabinet changes, thereby causing noise.

There has been proposed a surroundless loudspeaker to prevent the noise. FIG. 64 shows an example of such a surroundless speaker wherein the surround 15 of FIG. 63 is removed. Instead, a cylindrical impedance ring 10 is secured to the underside of the edge of the diaphragm along the outer periphery thereof, thereby forming a gap about 1 mm between the impedance ring 10 and the frame 7. The acoustic impedance of the sound waves in the frequency range of the speaker is large enough in the gap so that air is substantially prevented from flowing between the outside and the inside of the speaker cabinet.

The acoustic impedance is composed of acoustic resistance dependent on a viscosity of air, and acoustic inertance dependent of a mass of air which changes with the frequency of the sound waves. In a low frequency range, the acoustic inertance is so small as to be negligible, so that only the acoustic resistance need be considered. When the flow rate of the air is small, the acoustic resistance is determined in accordance with the width and the length of the gap. Thus, if the resonant frequency which is dependent on the shape of the gap is set smaller than several hertz, the acoustic impedance in the gap in the hearing area becomes large, thereby preventing leaking of the sound from the gap. Hence the sound pressure does not decrease. Consequently, the air is substantially prevented from flowing in and out of the cabinet, although the surround is not provided.

However, when trying to obtain a sound pressure equal to that of a larger loudspeaker in a speaker with a small cabinet, the moving distance of the diaphragm must be increased, which results in the fluctuation of the pressure in the cabinet. Thus, the flow rate of the air in the gap increases so that the above described conditions for preventing the noise cannot be satisfied. Whistling sound accordingly generates from the gap.

The phenomenon becomes significant as the capacity of the cabinet decreases. Hence it is difficult to manufacture a high-output small woofer without the surround.

SUMMARY OF THE INVENTION

An object of the present invention is to provide a small and high-output loudspeaker without a surround wherein whistling sound is prevented from generating from a gap between an annular ring and a frame of the loudspeaker.

According to the present invention, there is provided a surroundless loudspeaker system comprising, a cylindrical frame having a cylindrical supporting portion extending in an axial direction of the loudspeaker system and mounted in a cabinet, a magnetic circuit provided at a base end of the frame, a coil bobbin having a voice coil disposed in a magnetic gap of the magnetic circuit, a diaphragm having a peripheral free edge and connected to the coil bobbin at a central portion thereof, a cylindrical ring secured to the free end edge and disposed in the cylindrical supporting portion of the frame, for increasing acoustic impedance at a gap between the cylindrical ring and the supporting portion, and an annular sealing member secured to the cylindrical ring so that an outside peripheral wall thereof is slidably contacted with an inside wall of the cylindrical supporting portion of the frame.

The present invention further provides a surroundless loudspeaker system comprising, a frame having a cylindrical supporting portion extending in an axial direction of the loudspeaker system and mounted in a cabinet, a magnetic circuit provided at an end of the frame, a coil bobbin having a voice coil disposed in a magnetic gap of the magnetic circuit, a diaphragm having a peripheral free edge and connected to the coil bobbin at a central portion thereof, a damper provided between the cylindrical supporting portion and the coil bobbin for supporting the coil bobbin, the damper having an air permeability larger than a predetermined value so as to restrict flow of air passing through the damper.

In accordance with the present invention, there is provided a speaker system having a frame mounted in a cabinet, a magnetic circuit having an annular plate, a coil bobbin having a voice coil and disposed in a magnetic gap in the annular plate, and a diaphragm connected to the coil bobbin, characterized in that the voice coil comprises an outer coil and inner coil, each of the coils is disposed in the magnetic gap at half of axial length of the coil, and a whole of one of the coils in the magnetic gap when the other coil is out of the gap in an exciting state.

In an aspect of the present invention, the annular sealing member has a bent section at an edge portion thereof, and the edge portion is resiliently contacted with the inside wall of the cylindrical supporting portion of the frame.

The annular sealing member is made of deformable material such as fibrous and porous material.

The sealing member may be integral with the cylindrical ring.

The inside wall of the cylindrical supporting portion of the frame is made of material softer than that of the annular member, and has a plurality of bumps and pits or a plurality of grooves arranged in the axial direction.

The inside wall of the cylindrical supporting portion may be coated with a lubricant.

The speaker system has damper means provided between the cylindrical supporting portion and the coil bobbin for supporting the coil bobbin.

The damper means comprises an outer damper and an inner damper. Each of the damper is made of cloth comprising warps and wefts.

These and other objects and features of the present invention will become more apparent from the following detailed description with reference to the accompanying drawings.

BRIEF DESCRIPTION OF DRAWINGS

FIGS. 14 to 16 are tables showing calculations for obtaining conversion efficiencies in vibrating systems with the short voice coil, double voice coil, and the long voice coil, respectively;

DETAILED DESCRIPTION OF THE PREFERRED EMBODIMENT

Figure 63:
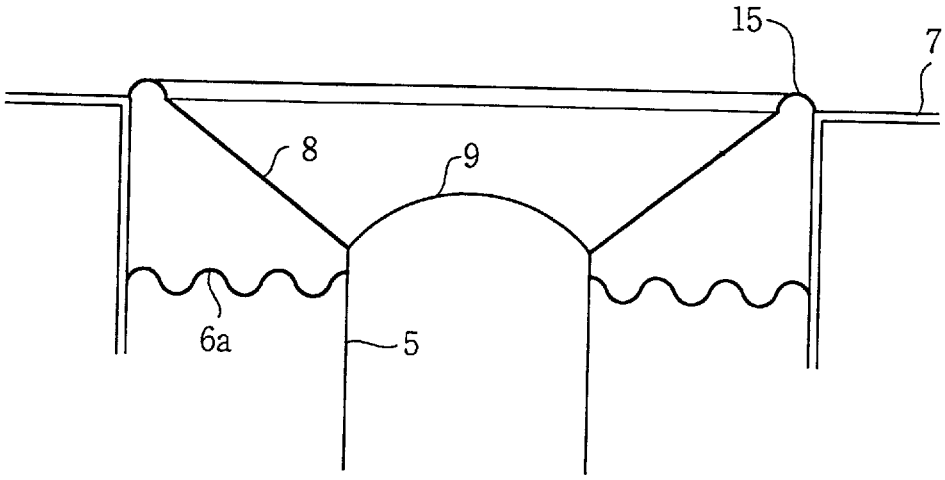
FIG.63 PRIOR ART
FIG. 63 is a schematic diagram of a conventional loudspeaker having a surround.
Figure 64:
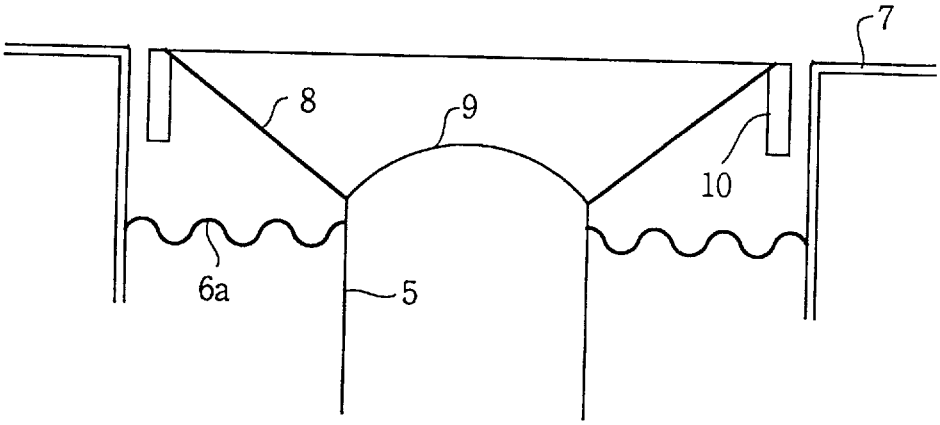
FIG.64 PRIOR ART
FIG. 64 is a schematic diagram of a conventional surroundless loudspeaker.

The loudspeaker according to the present invention is described hereinafter with reference to FIG. 1 wherein the same references as those in FIGS. 63 and 64 designate the same parts.

Figure 1:
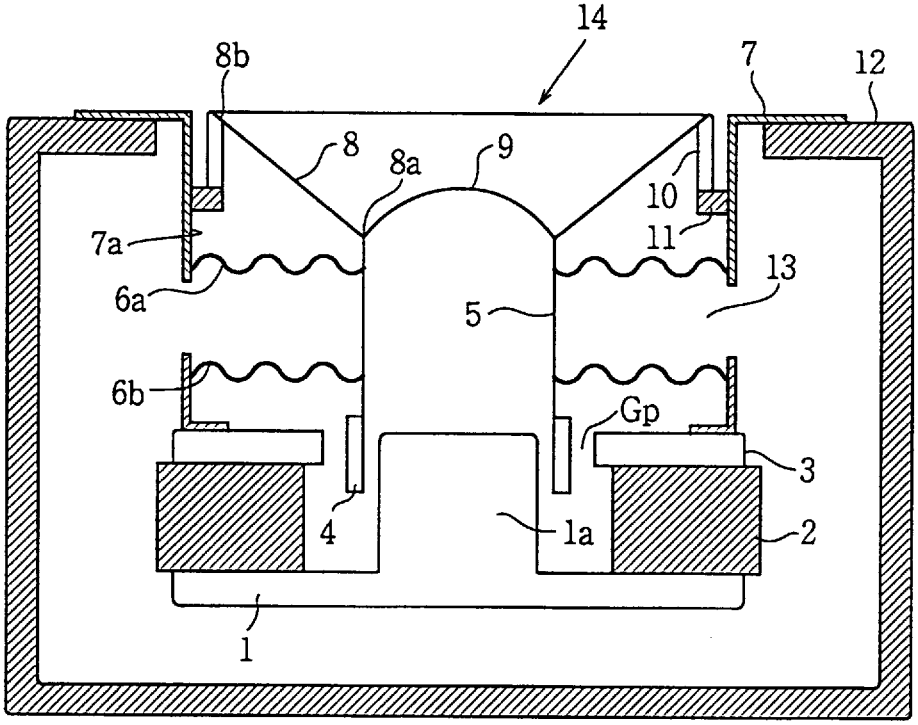
FIG. 1 is a sectional view of a surroundless cone loudspeaker according to the present invention.

Referring to FIG. 1, a cone loudspeaker of the present invention has a disc metal yoke 1 having a large permeability and a pole piece 1*a*, annular magnet 2 mounted on the periphery of the yoke 1, and an annular metal plate 3, having a large permeability, mounted on the magnet 2, thereby forming a magnetic circuit. A magnetic gap Gp is formed between the pole piece 1*a* and the plate 3. The cylindrical frame 7 is mounted on the plate 3. The assembly of the conical diaphragm 8, the bobbin 5 having the coil 4, and the center cap 9 is provided in the frame 7. The frame 7 is mounted in a cabinet 12. A pair of outer and inner dampers 6*a* and 6*b* are secured to the peripheries of the bobbin 5 and the inside wall of the frame 7 to hold the bobbin 5. Thus, when the bobbin 5 moves in the gap Gp between the plate 3 and the pole piece 1*a* in the axial direction, the distances between the bobbin 5 and the pole piece 1*a* and the plate 3 are always maintained constant. The dampers 6*a* and 6*b* are made of a porous material comprising a piece of fabric immersed in resin and heat molded so that the bobbin 5 is accurately moved and stopped.

Figure 2:
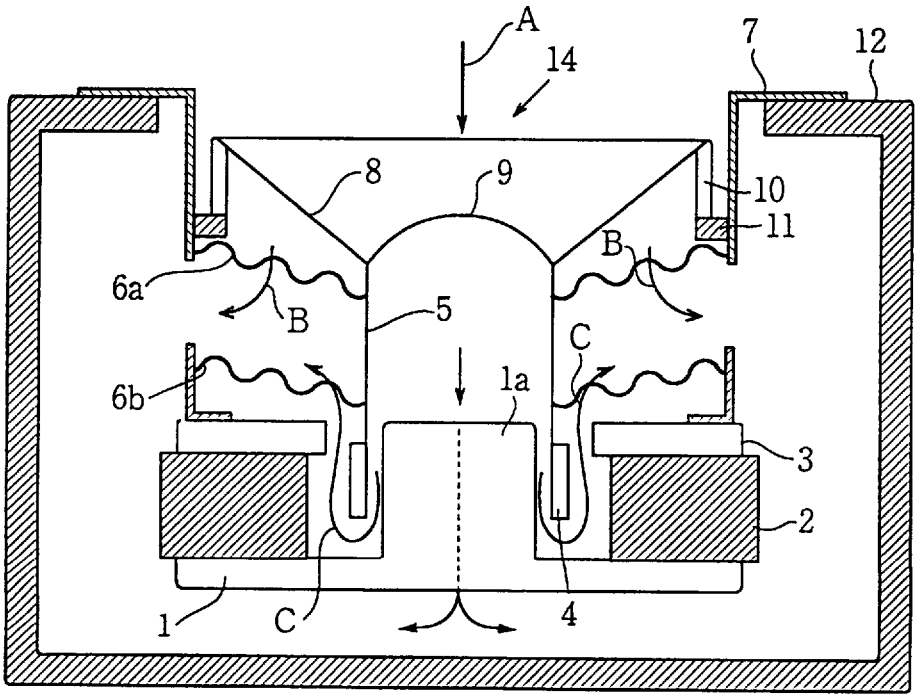
FIG. 2 is a sectional view of the loudspeaker of FIG. 1 describing the operation thereof.

The pole piece 1*a* has a passage passing therethrough in the axial direction as shown by arrows in FIG. 2. The cap 9, together with the diaphragm 8, bobbin 5 and the voice coil 4 forms a vibrating system 14. A plurality of openings 13 are provided on the cylindrical wall of the frame 7 so as to allow air in the frame 7 to escape into the inner space of the cabinet 12 when the diaphragm 8 makes a large and abrupt reciprocal axial movement.

Attached on an outer periphery 8*b* of the diaphragm 8 is provided the cylindrical ring 10, thereby forming a gap of about 1 mm between the ring and an inner surface 7*a* of the frame 7. An annular sealing member 11 is attached around the lower edge of the ring 10.

The sealing member 11 is made of fiber such as felt, or of a foam such as foam urethane. Hence the diaphragm 8 is able to move in the frame 7 in the axial direction thereof, sliding the sealing member 11 on the inside wall 7*a* of the frame 7.

When applied with audio current, the voice coil 4 generates a magnetic force and moves vertically in the magnetic gap Gp. The vibrating system 14 is hence displaced.

FIG. 2 shows the vibrating system 14 in a retracted position, that is when moved in a direction shown by an arrow A. When the vibrating system 14 is thus moved, the air in the frame 7 is compressed in accordance with the moving distance of the vibrating system. The air compressed by the diaphragm 8 passes through the porous damper 6*a* and enters the inner space of the cabinet 12 through the openings 13 as shown by arrows B. A part of the air in the bobbin 5 flows through the opening of the pole piece 1*a*. The remaining part flows through the porous damper 6*b* to the inner space of the cabinet 12 as shown by an arrow C. Thus, the air in the cabinet 12 is compressed.

Although the air in a space defined by the diaphragm 8 and the damper 6*a* is subjected to some change of pressure due to the displacement of the vibrating system 14, the sealing member 11 blocks the passage of the air through the gap between the frame 7 and the diaphragm 8 so that the air flows only through the porous damper 6*a*.

When the vibrating system 14 moves forward in the opposite direction of the arrow A, the air is decompressed in accordance with the distance of the displacement. The air flows in the opposite directions from those shown by the arrows B and C in FIG. 2. Since the sealing member 11 is provided, the air does not enter the inner space of the frame 7 through the gap between the diaphragm 8 and the frame 7. Hence, although the vibrating system 14 is largely displaced, the flow of air through the gap does not occur. Thus the whistling sound does not generate.

As a result, although the vibrating system 14 may move largely and abruptly in the axial direction, causing the pressure in the cabinet 12 to change, air does not flow through the space between the frame and the diaphragm 8.

In a second embodiment of the present invention, instead of the porous material for the dampers, a material having an air permeability larger than a predetermined value is used as the material of the outer damper 6*a*. Accordingly, air is less freely passed through the damper 6*a*. Thus the air in the cabinet 12 does not enter the space between the damper 6*a* and the diaphragm 8. As a result, even in a speaker without the sealing member 11 as shown in FIG. 64, the quantity of air which passes through the gap between the ring 10 and the frame 7 becomes extremely small. Namely, the space defined by the diaphragm 8 and the damper 6*a*, when compressed or decompressed owing to the movement of the vibrating system 14, is subjected to a small change so that only a small quantity of air flows through the gap. However, the change of pressure is so small compared to the change of the pressure in the cabinet 12 so that whistling sound does not generate.

The damper 6*a* is composed of a material having a permeability equal to or larger than 3 S/100 cc detected in accordance with a permeability test conducted under conditions set in the Japanese Industrial Standard (P8117-1980), "Permeability Test for Paper and Millboard". Although sufficient result was achieved with the damper 6*a* having the permeability of 3 S/100 cc, the effect was enhanced with a damper having a permeability more than 5 S/100 cc.

The heretofore described embodiments of the present invention may be further modified to be provided with only one damper 6*a*. Moreover, the sealing member 11 may be provided on the outer surface of the ring 10 instead of on the bottom edge thereof.

In a corn loudspeaker, a force F which is exerted on the vibrating system is expressed as a product of an effective magnetic flux density B, effective length $\ell$ of the voice coil and audio current i ($F=B\times\ell\times i$). It is preferable to maintain the force factor ($B\times\ell$) of the force F large and constant despite the displacement of the voice coil. Namely, when the voice coil is driven to be displaced, the magnetic flux density in a predetermined range of the displacement cannot be maintained even. Thus the force factor ($B\times\ell$) fluctuates thereby causing distortions in sound.

Such a distortion occurs due to the fact that the distribution of the force factor is uneven when the moving distance of the voice coil is large, namely in a low frequency range. More particularly, in a loudspeaker where the caliber is large, the maximum moving distance hardly needs to be increased to produce a large output. On the other hand, in the case of a speaker with a small caliber, in order to produce a low note, the voice coil must be moved a large distance. As a result, the voice coil is extruded out from the magnetic gap, thereby causing a large distortion in sound due to the fluctuating force factor. In the surroundless loudspeaker, since the voice coil is allowed to move a larger distance, the herein described tendency is enhanced.

Figure 3:
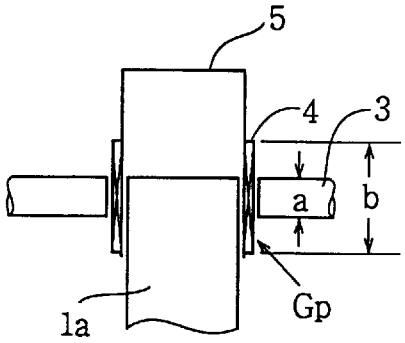
FIG. 3 is a schematic diagram of a vibrating system of a loudspeaker provided with a long voice coil.

In order to maintain the distribution of the force factor even so that the distortion of sound is prevented, there has been proposed two methods. The first uses a long voice coil as shown in FIG. 3. A length b of the voice coil 4 wound around the bobbin 5 is larger than a thickness a of the plate 3. Hence the voice coil 4 in the magnetic gap Gp between the plate 3 and the pole piece 1*a*, wherever it may be positioned within its moving range, is always in 100% interlinkage with the magnetic flux in the gap.

Figure 4:
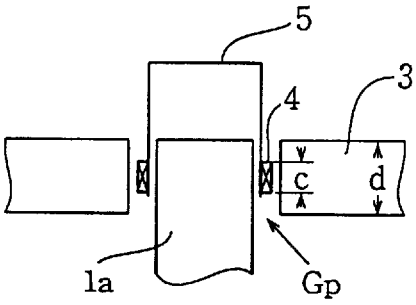
FIG. 4 is a schematic diagram of a vibrating system of a loudspeaker provided with a short voice coil.

The second method uses a short voice as shown in FIG. 4. Namely, a length c of the voice coil 4 is shorter than a thickness d of the plate 3. Thus, the moving range of the voice coil 4 is limited within the magnetic gap Gp where the magnetic flux density is constant.

The vibrating system with the long voice coil is advantageous in that, since the vice coil is always in 100% interlinkage with the magnetic flux in the gap Gp, it is not necessary to enlarge the magnetic circuit. However, since the length b of the voice coil 4 is larger than the thickness a of the plate 3, not only is the mass of the conductive wire comprising the voice coil increased, the effective length is decreased, thereby decreasing the conversion efficiency of the speaker.

To the contrary, the conductive wire for the short voice coil has a small mass. Since the voice coil moves only within a range of the magnetic gap Gp wherein the magnetic flux density is even, mean magnetic flux density does not decrease, so that the conversion efficiency can be increased. On the other hand, in order to maintain the force factor (B× ℓ) constant even when the voice coil moves a large distance, the thickness of the plate 3 must be increased. Consequently, a large magnetic circuit becomes necessary, causing a rise in the manufacturing cost.

A use of double voice coil is proposed for eliminating these problems in the surroundless speaker. The vibrating system having the double voice coil is described hereinafter with reference to FIGS. 5 to 20.

In an actual loudspeaker, whereas the magnetic flux density is even in the magnetic gap Gp, an uneven leakage flux is generated outside the gap. The voice coil is affected by the leakage flux. The description set hereinafter aims to theoretically explain the relative position of the voice coil so that the influence of the leakage flux is ignored for the ease of the explanation.

Figure 5:
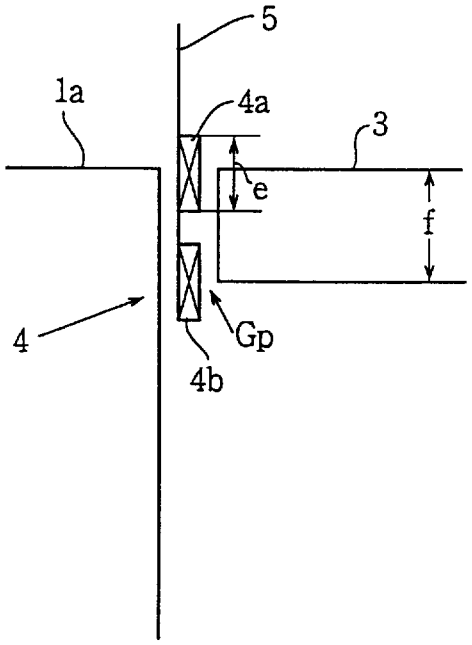
FIG. 5 is a schematic diagram of a vibrating system of a loudspeaker provided with a double voice coil.

Referring to FIG. 5, the magnetic circuit comprises the plate 3 having a thickness f, and the pole piece 1*a*, thereby forming the magnetic gap Gp therebetween. The voice coil 4 which is wound around the bobbin 5 comprises an outer coil 4*a* and an inner coil 4*b*. Each of the coils 4*a* and 4*b* has the same length e so that the entire length of the voice coil 4 is 2*e*. The coils 4*a* and 4*b* are wound in the same direction and conductive with each other. The coils 4*a* and 4*b* are so positioned that one half of the length e (e/2) of each of the coils is positioned in the magnetic gap Gp when the vibrating system is inoperative.

Figure 6A:
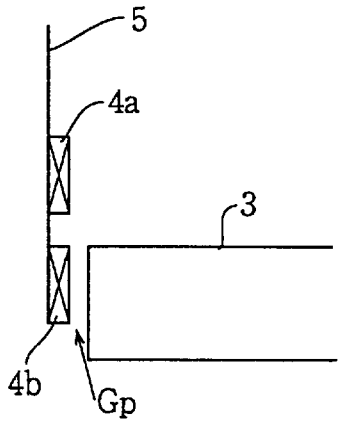
FIG. 6*a* is a schematic diagram showing the double voice coil of FIG. 5 when the vibrating system is displaced toward the front of the speaker.
Figure 6B:
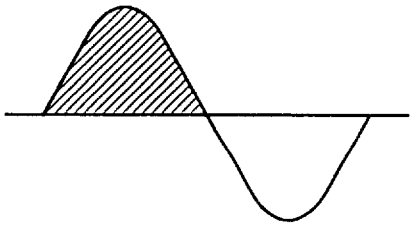
FIG. 6*b* is a graph showing a wave of an acoustic current when the vibrating system is operated as shown in FIG. 6*a;*
Figure 7A:
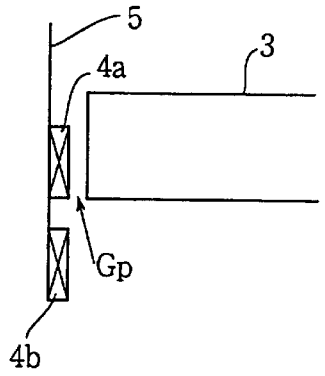
FIG. 7*a* is a schematic diagram showing the double voice coil of FIG. 5 when the vibrating system is displaced to the rear of the speaker.

Referring to FIGS. 6*a* and 7*a*, the maximum moving distance of the coils are so determined that either the coil 4*b* or the coil 4*a* stays in the magnetic gap Gp when bobbin 5 of the vibrating system is moved a maximum distance. Namely, as shown in FIG. 6*b*, when the acoustic current is in a positive half-wave, the voice coil 4 moves forward, that is upward in the figure. At the highest current, although the outer coil 4*a* ejects out of the magnetic gap Gp while the inner coil 4*b* stays therein as shown in FIG. 6*a*.

Figure 7B:
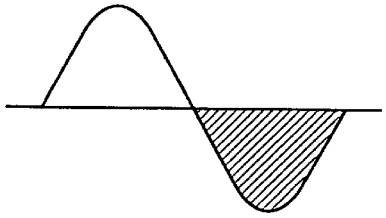
FIG. 7*b* is a graph showing a wave of an acoustic current when the vibrating system is operated as shown in FIG. 7*a;*

When the acoustic current is in a negative half-wave as shown in FIG. 7*b*, the voice coil 4 is moved rearward, or downward in the figure. Even when the current is at the highest, the outer coil 4*a* stays in the magnetic gap Gp although the inner coil 4*b* moves out of the gap Gp as shown in FIG. 7*a*.

Figure 8:
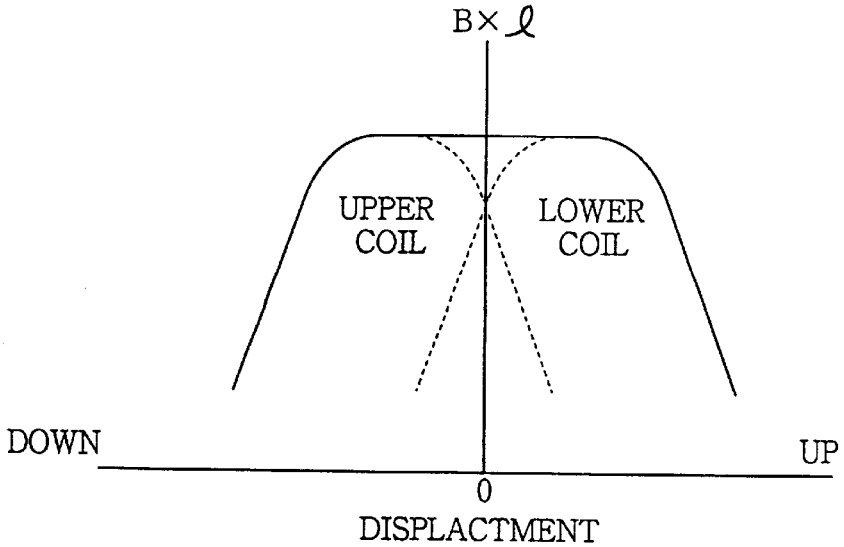
FIG. 8 is a graph showing characteristics of the force factor in the speaker having the vibrating system of FIG. 5.

Thus the effective length of the voice coil 4 can always be considered as the length e in the cases shown in FIGS. 6*a* and 7*a*. When the moving distance of the voice coil 4 is small, a part of the coil 4*a* and a part of the coil 4*b* are within the magnetic gap Gp so that the total of the lengths of the coils 4*a* and 4*b* adds up to the length e. Namely as shown in FIG. 8, the force factor (B× ℓ) is kept constant.

In operation, when the voice coil 4 is applied with the audio current, the outer and inner coils 4*a* and 4*b* in the magnetic gap Gp between the plate 3 and pole piece la are subjected to a magnetic field. When the applied current is in the positive half-wave as shown in FIG. 6*b*, the voice coil 4 is moved to the front. When the peak value of the half wave is large, that is when the voice coil 4 is largely displaced, the outer coil 4*a* is extruded out of the magnetic gap Gp as shown in FIG. 6*a*. The entire portion of the inner coil 4*b* meanwhile stays in the magnetic gap Gp. Thus the effective length is kept at the length e. Hence the force factor (B× ℓ) does not change.

When the current is in the negative half-wave as shown in FIG. 7*b*, the voice coil 4 is force to be retracted. If the peak value of the half-wave is large, that is the distance of the displacement is large, the inner voice coil 4*b* is expelled out of the magnetic gap Gp while the outer coil 4*a* is positioned therein as shown in FIG. 7*a*. The effective length in the present case also equals the length e so that the force factor (B× ℓ) stays the same.

If the peak values of the positive and negative half-waves are small, that is when the voice coil moves only a small distance, a part of each of the outer and inner coils 4*a* and 4*b* is subjected to the magnetic field. Since the sum of the effective lengths of the coils 4*a* and 4*b* is always the length e, the force factor (B× ℓ) is kept unchanged.

FIGS. 9 to 13 show relationships between conversion efficiency of loudspeakers and the effective length of the double voice coil vibrating system, and conventional long and short voice coil vibrating systems. The displacement range of the vibrating system of each speaker is ±20 mm, and the weight of the vibrating system excluding the voice coil varies from 3 to 20 g in FIGS. 9 through 13.

The conversion efficiency in the graphs was calculated in accordance with the following equation.

$$\eta=(W_a+W_e)\times 100(\%)=((50\times\pi\times\rho_0\times a^4\times B^2\times m_v)/C)\ m_v+m_d+2m_{ad})^2)\times(1/K_r{}^1\rho)\times A$$

where $W_a$ is an-input power (W), $W_e$ is an acoustic output (W), $\rho_0$ is an air density, a is a diameter of the diaphragm, B is a magnetic flux density $m_v$ is a weight of effective length, $m_d$ is a sum of the weight of the diaphragm and the weight of the ineffective length, $m_{ad}$ is an additional mass of air, C is a sound velocity, $K_r{}^1$, is a resistivity of the conductive wire of the voice coil, ρ is a density of the voice coil, and A is a ratio of the effective length of the voice coil to the entire length.

The magnetic flux density B in the equation is as given by $$B=((A_m\times K\times H_c\times B_r)/((K\times H_c\times A_g)+B_r)\times(A_m/A_g)$$

In the equation, K is a constant which is expressed as $$K=\mu_0\times(L_m/A_m\times L_g)$$

where $\mu_0$ is a permeability, $A_m$ is an area of the magnet, $A_g$ is an area of the magnetic gap, $L_m$ is a thickness of the magnet, $L_g$ is a length of the magnetic gap, that is the thickness f of the plate, $B_r$ is a residual magnetic flux density, $H_c$ is a coercive force.

The weight $m_v$ of the effective length is expressed as $$m_v=\pi\times\rho\times r^2\times \ell$$

where ρ is a density of the conductive wire, r is a radius of the conductive wire and ℓ is an active length of the voice coil. The effective length ℓ is further given by $$\ell = 3\sqrt{(\pi^3 \times \phi^2 \times R_{vc} \times L^2/4K_r)} \times A$$

where r is a radius of the conductive wire, $\phi$ is a diameter of the coil, $R_{vc}$ is a direct current resistance, L is an entire length of the voice coil, $K_r$ is a resistivity, and A is a ratio of the effective length to the entire coil length. 3 √ in the equation represents a cubic root.

For example, in the short voice coil vibrating system, the ratio A is one, and in the double voice coil vibrating system, 0.5. In the long voice coil vibrating system, the ratio A is $T_p/L$ where $T_p$ is an opposing length, namely the thickness of the plate.

Figure 9:
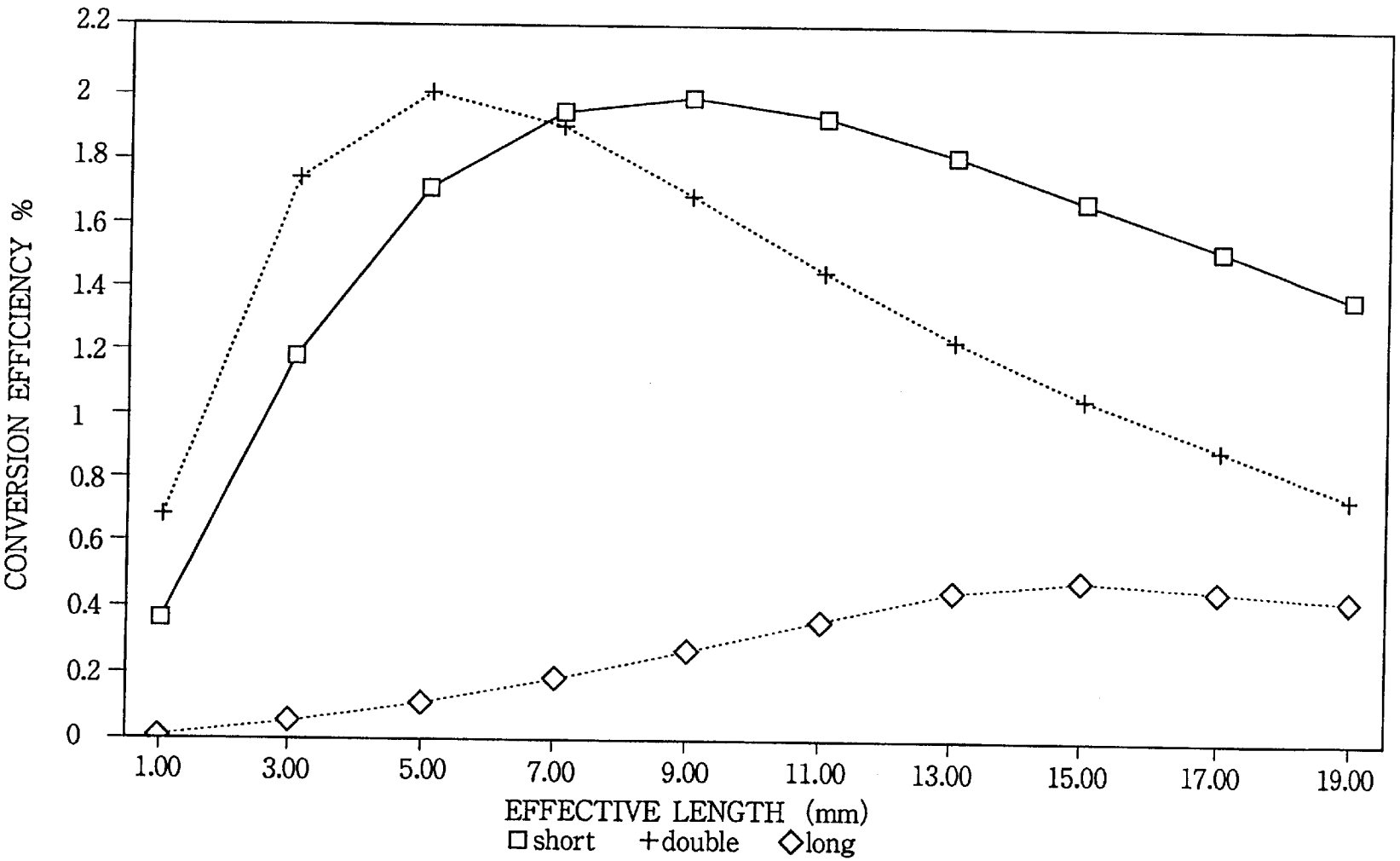
FIGS. 9 to 13 are graphs each showing a relationship between a conversion efficiency and an effective length of the short voice coil, double voice coil, and the long voice coil in vibrating systems having various weights.

Referring to FIG. 9 showing the relationship between the conversion efficiency and the effective length in vibrating systems weighing 3 g, exclusive of the voice coils. The vibrating systems provided with the double voice coil and short voice coil have better conversion efficiency than that with a long voice coil. The conversion efficiency of the double coil vibrating system is improved compared to that of the short coil vibrating system in a range of the coil length up to about 7.00 mm. The peak value of the conversion efficiency of the double coil vibrating system is 2% which is obtained when the effective length of the coil is about 5 mm.

Figure 10:
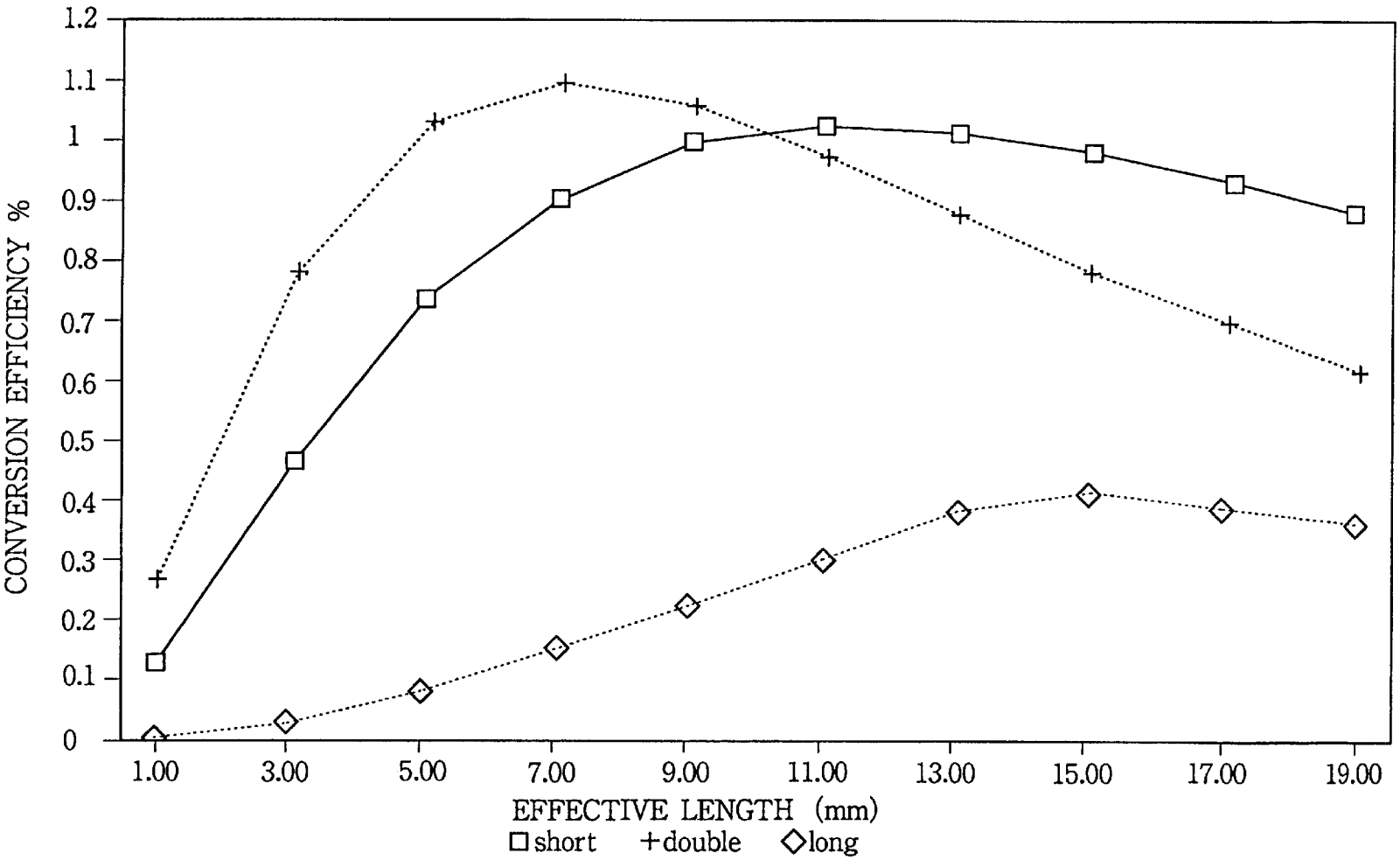

As shown in FIG. 10, in loudspeakers where the weights of the vibrating systems each excluding the voice coils are 5 g, the conversion efficiency is likewise improved in the systems with double and short voice coils than those with long voice coils. The vibrating system with the double voice coil has better conversion efficiency than that with the short voice coil in a range of the effective length up to about 10 mm. The peak value of the conversion efficiency of the double voice coil loudspeaker is 1.1% which is obtained when the effective length is about 7 mm.

Figure 11:
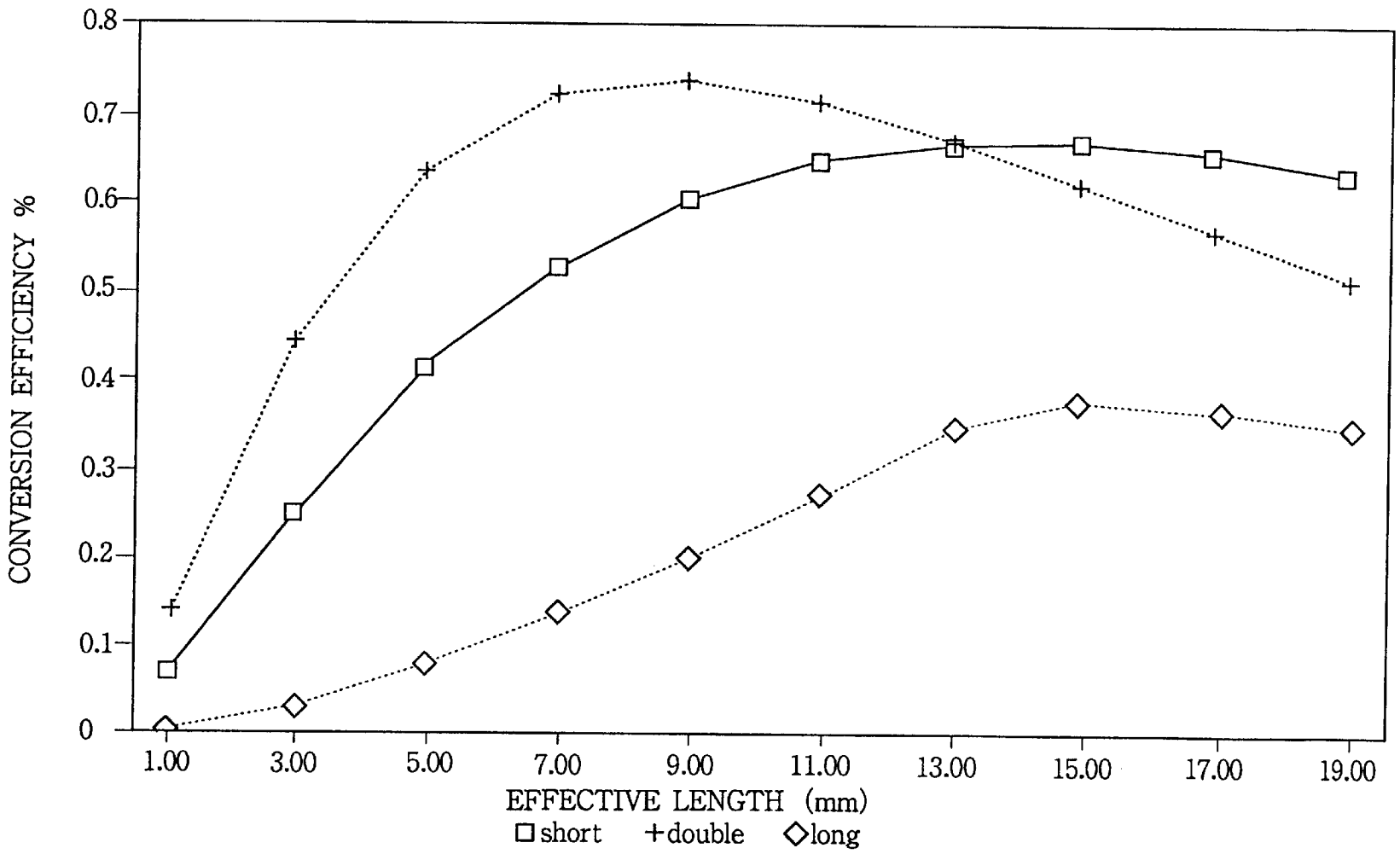

The same can be said for the vibrating system weighing 7 g excluding the voice coil. Namely as shown in FIG. 11, the conversion efficiencies of the vibrating systems with the double and short voice coils are superior to that of the vibrating system with a long voice coil. The vibrating system with the double voice coil has a better conversion efficiency than that with the short voice coil in a range of the effective length up to about 13 mm. The peak value of the conversion efficiency of the double voice coil loudspeaker is 0.73% which is obtained when the effective length is about 9 mm.

Examples of the calculated conversion efficiencies in the short voice coil vibrating system, double voice coil vibrating system, and long coil vibrating system are shown in tables in FIGS. 14 to 16, respectively.

Figure 12:
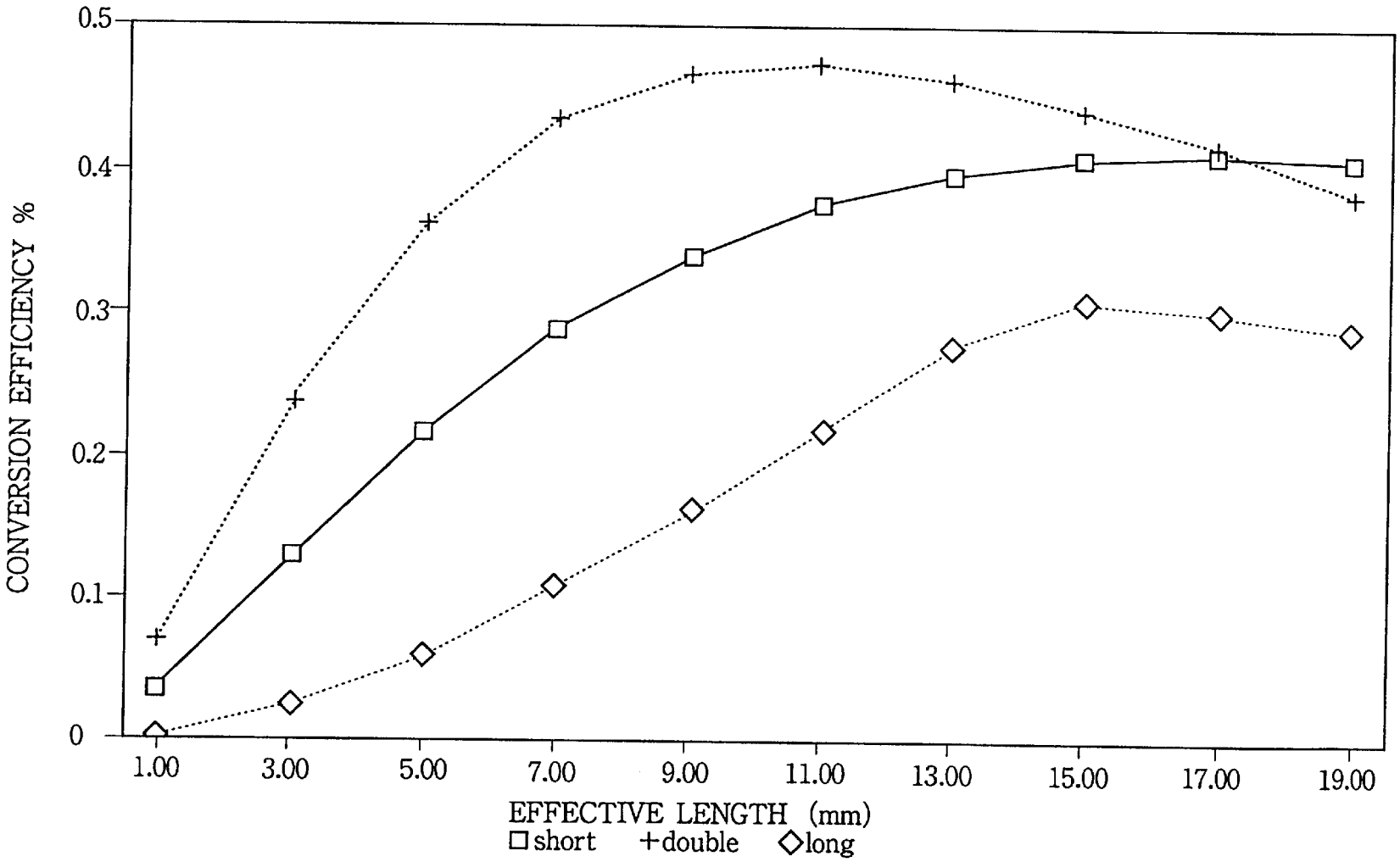

FIG. 12 shows the relationship between the conversion efficiency and the effective length of the voice coil in speakers where the vibrating system without the voice coil weighs 10 g. The conversion efficiencies of the double and short voice coil vibrating systems are superior to that of the long voice coil vibrating system. When the effective length is smaller than a length about 17 mm, the conversion efficiency of the double voice coil is better than that of the short voice coil. The peak value of the conversion efficiency is 0.47% which is obtained when the actual coil length is about 11 mm.

Figure 13:
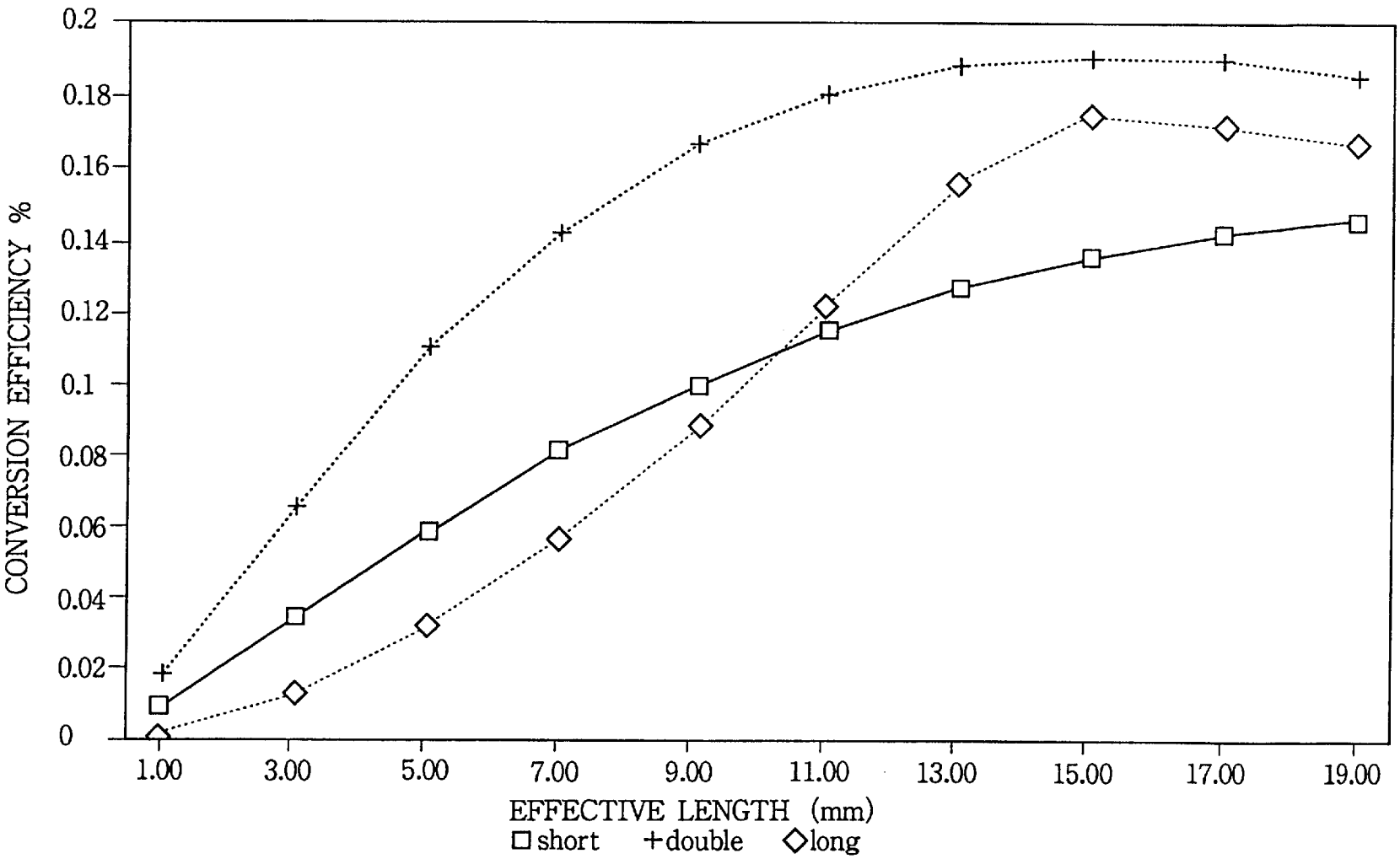

Referring to FIG. 13 showing the relationship between the conversion efficiency and the effective length in a vibrating systems weighing 20 g, exclusive of the voice coils, the vibrating system provided with double voice coil has better conversion efficiency than that with the short voice coil and long voice coil, although the conversion efficiency of the long coil vibrating system is improved compared to that of the short coil vibrating system in a range of the coil length of up to about 10.00 mm. The peak value of the conversion efficiency of the double coil vibrating system is 0.19% which is obtained when the effective length is about 15 mm.

FIGS. 17 to 20 show weight ratios, that is ratios of the weight of the entire voice coil to the total weight of the vibrating system including the voice coil wherein the weight of the vibrating system excluding the voice coil is 3 g, 5 g, 7 g, and 10 g, respectively. The displacement of the vibrating system is also in the range of ±20 mm.

Figure 17:
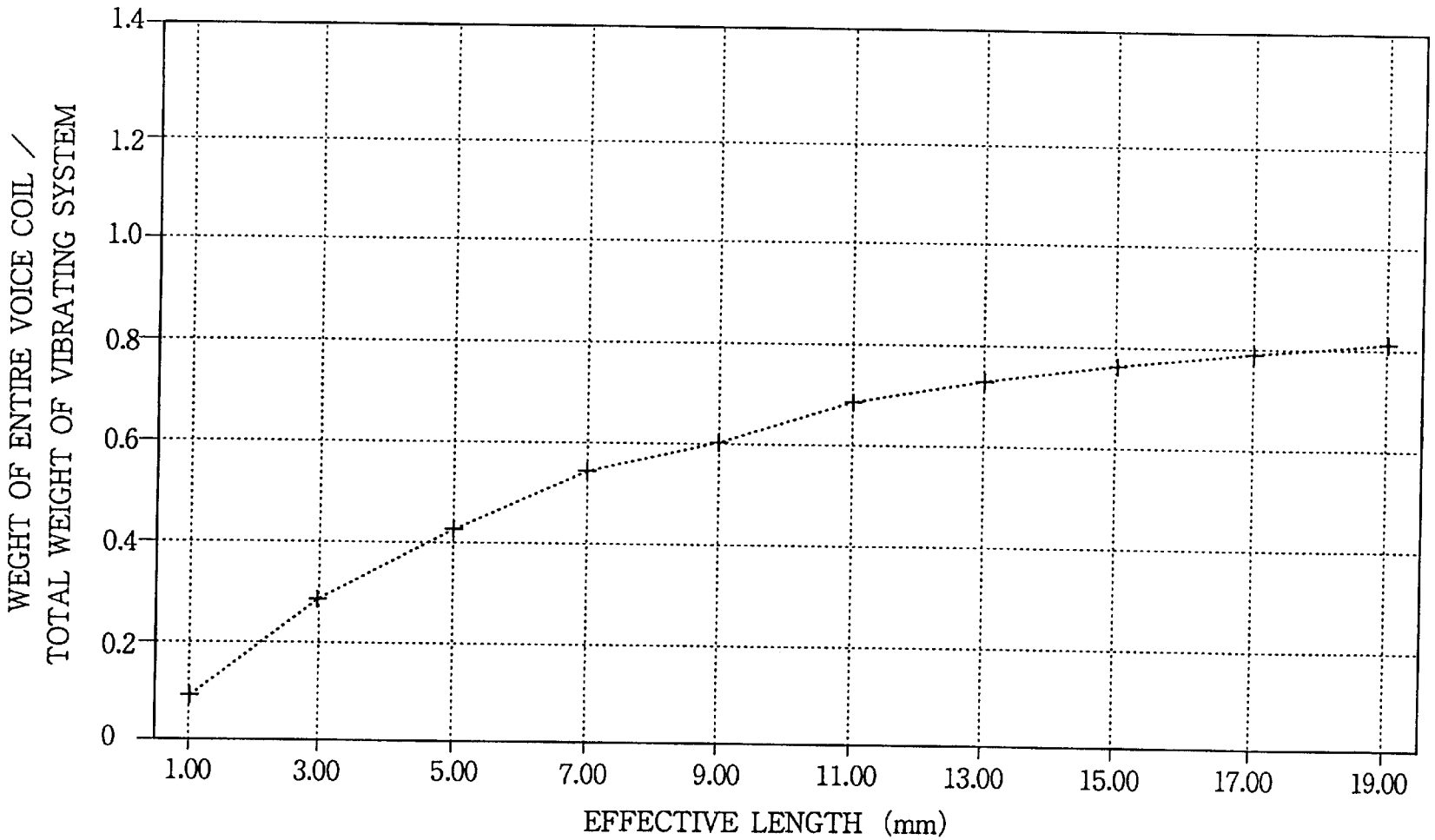
FIGS. 17 to 20 are graphs each showing a relationship between a ratio of weight of entire voice coil to total weight of the vibrating system and an active coil length of the double voice coil in vibrating systems having various weights.

Referring to FIG. 17, in the case where the vibrating system without the voice coil is 3 g, the ratio is 0.53 when the effective length is 7 mm, which is a length where the conversion efficiency of the short voice coil vibrating system exceeds that of the double voice coil vibrating system as shown in FIG. 9.

Figure 18:
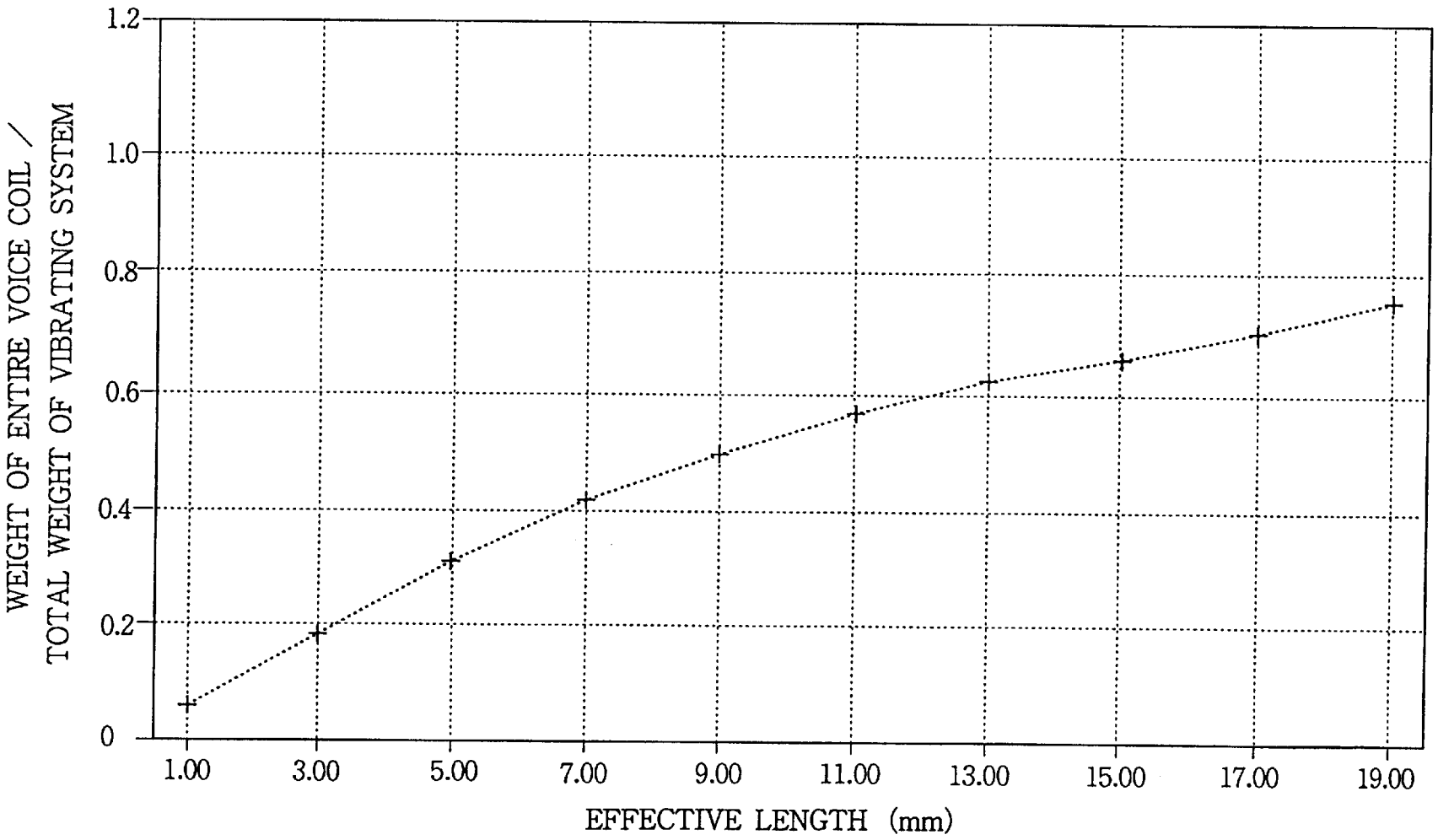

As shown in FIG. 18, in the vibrating system the weight of which without the voice coil is 5 g, the ratio of the weight of the entire voice coil to the total weight of the vibrating system including the voice coil is 0.53 at the effective length of 10 mm, where the conversion efficiency of the short coil vibrating system exceeds that of the double voice coil vibrating system as shown in FIG. 10.

Figure 19:
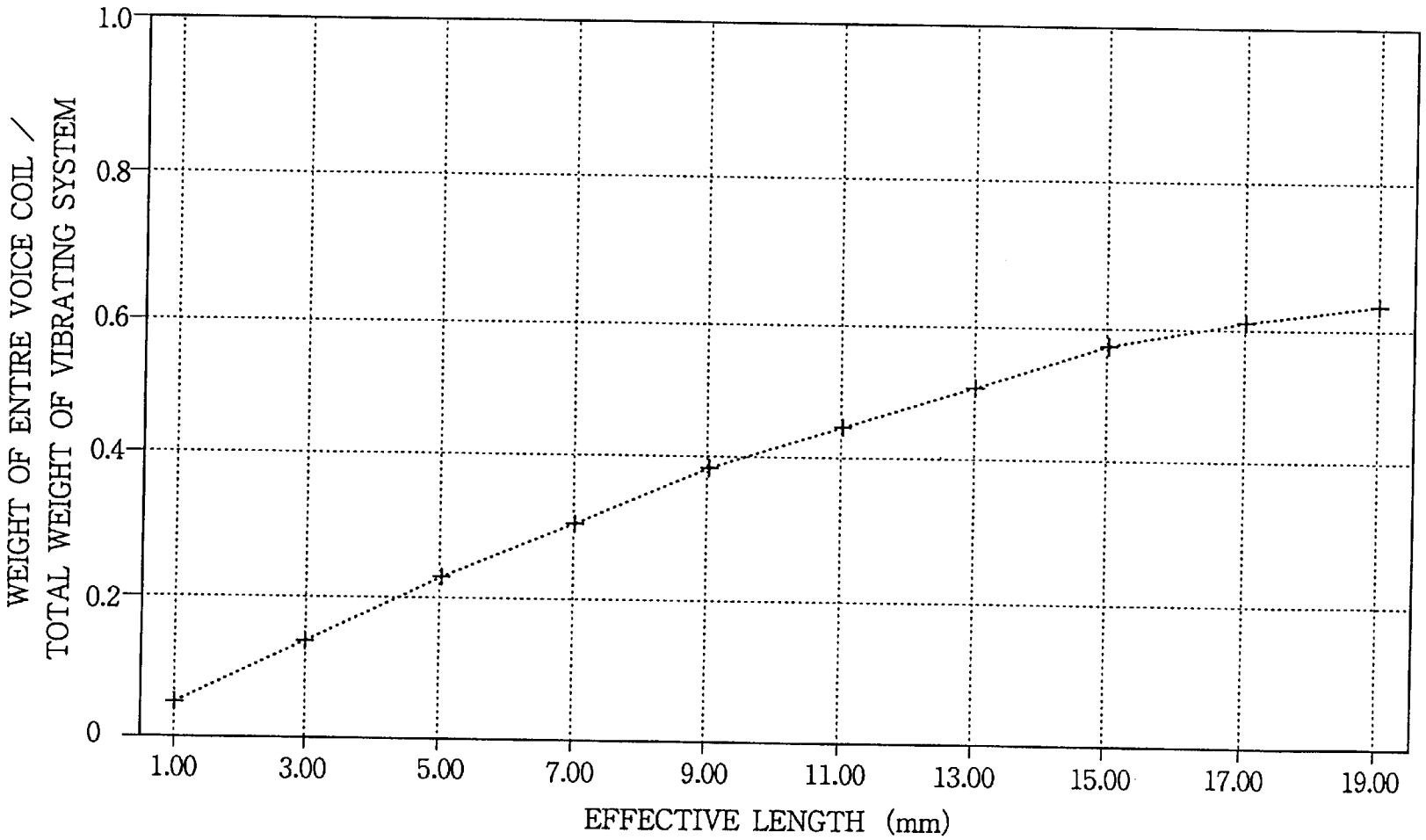

Referring to FIG. 19, in the case where the vibrating system without the voice coil is 7 g, the ratio is 0.51 when the effective length is 13 mm, at which the conversion efficiency of the short voice coil vibrating system exceeds that of the double voice coil vibrating system as shown in FIG. 11.

Figure 20:
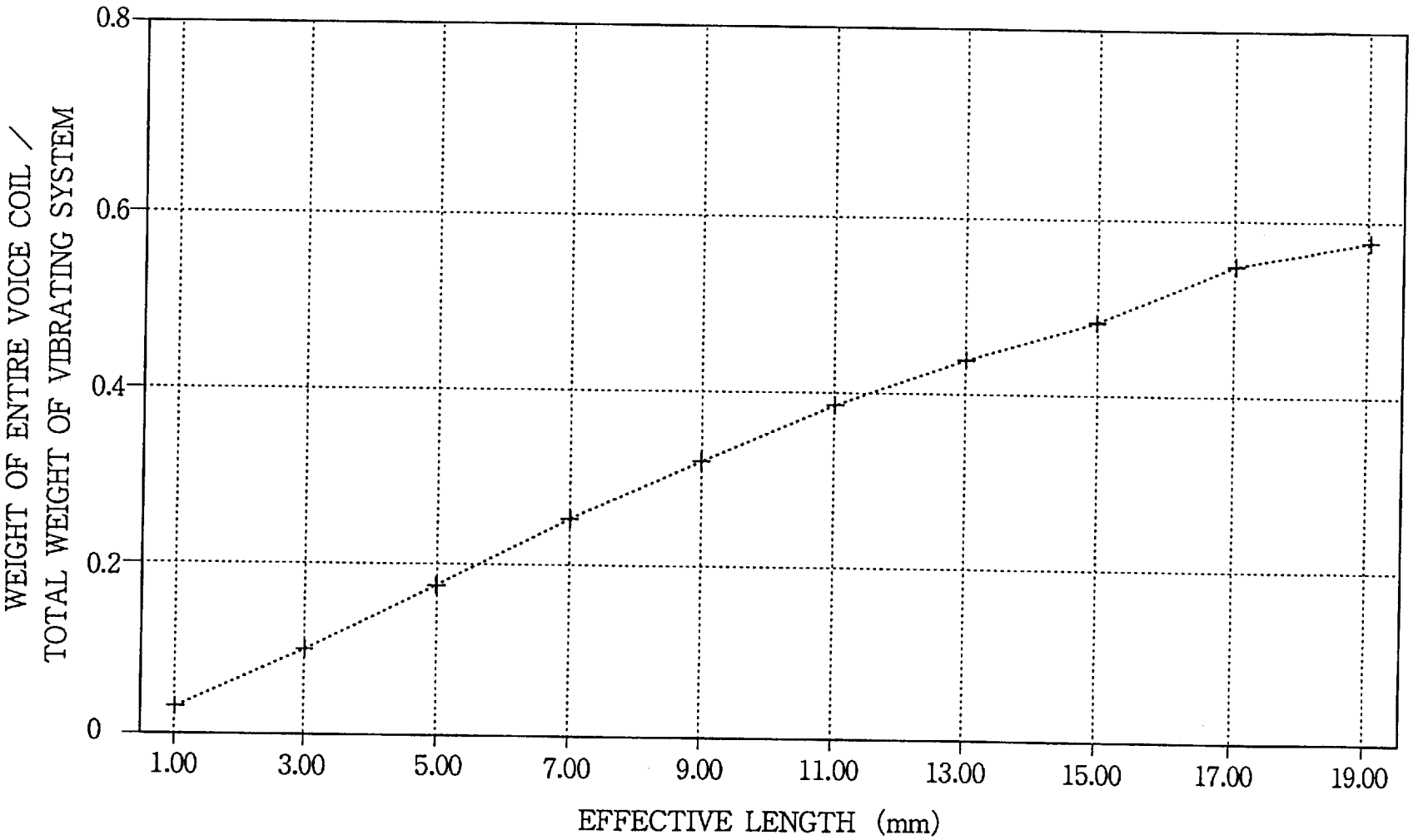

As shown in FIG. 20, when the vibrating system without the voice coil is 10 g, the ratio of the weight of the entire voice coil to the total weight of the vibrating system including the voice coil is 0.55, at the effective length of 17 mm, where the conversion efficiency of the short coil vibrating system exceeds that of the double voice coil vibrating system as shown in FIG. 12.

The above examples show that as long as the weight ratio is smaller than 0.50, the double voice coil vibrating system provides the maximum conversion efficiency among the vibrating systems having the double, short and long voice coils.

When the double voice coil is thus provided in the surroundless speaker, while the bobbin 5 is inoperative, a half of the entire length of the outer and inner coils 4*a* and 4*b* are disposed in the magnetic gap Gp formed between the plate 3 and the pole piece 1*a* where the magnetic flux density is even. The coils are so adapted to move in operation that although one of the coils is out of the magnetic gap Gp, the other stays therein. A half of the entire length of each of the coils 4*a* and 4*b* is positioned in the magnetic gap Gp even at the maximum displacement thereof, so that the force factor ($B \times \ell$) is always maintained constant.

Hence, contrary to the short voice coil vibrating system, the thickness of the plate 3 need not be increased to be ready for the large displacement, thereby enabling to decrease the size of the magnetic circuit. When compared to the long voice coil vibrating system, the length of the voice coil need not be designed larger than the thickness of the plate 3 to ensure the 100% interlinkage, so that the mass of the conductor wire thereof is decreased, thereby preventing the manufacturing cost to rise.

In the actual loudspeaker, there occurs a leakage flux, the density of which is uneven, outside the magnetic gap although the present embodiment has been theoretically described ignoring the leakage. The outer and inner coils are influenced by the leakage flux. In order to maintain the force factor ($B \times \ell$) constant, it is advisable to determine the portion of each coil which ejects out while inoperative a little larger than the portion staying in the gap Gp, instead of dividing the length e by half (e/2) as described above.

Referring back to FIG. 1, when there are dimensional variances in the frame 7 and in the ring 10, or diversions thereof due to the change in temperature, there may be partially formed a space between the sealing member 11 and the inner surface 7*a* of the frame 7. Air flows in the space thereby causing a whistling sound, thereby deteriorating the sound, and hence the performance of the loudspeaker. Thus, the loudspeaker lacks in reliability.

FIGS. 21 to 29 show various examples of the sealing member 11 of the loudspeakers provided in order to increase the reliability thereof.

Figure 21:
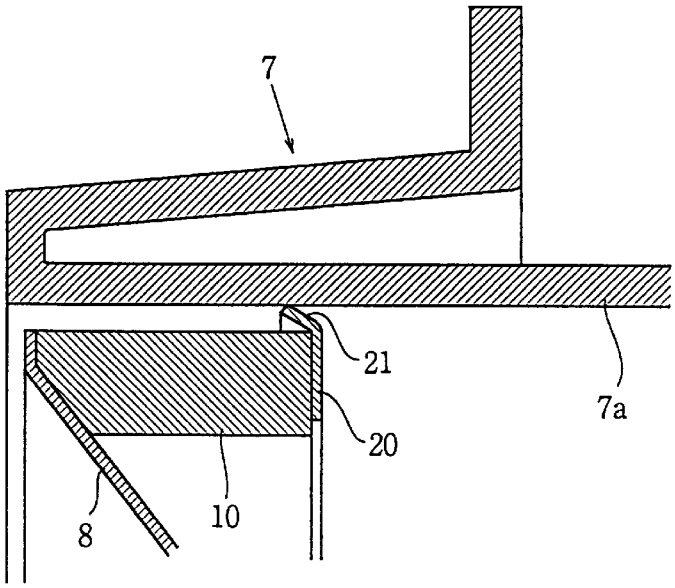
FIG. 21 is a sectional view showing a first modification of a sealing member provided in the loudspeaker of FIG. 1.

Referring to FIG. 21, an annular sealing member 20 having a thin thickness is made of an elastic deformable material such as rubber, foam rubber and porous fibers, and attached on the inner periphery of the ring 10. The sealing member 20 has a flange 21 on the outer periphery thereof, which resiliently contacts with the inner surface 7*a* of the frame 7 to be outwardly bent. Thus, the sealing member hermetically seals the space defined by the diaphragm 8, ring 10 and the frame 7. Namely, air is prevented from flowing in and out of the frame 7 and hence of the cabinet 12.

When the diaphragm 8 vibrates, the sealing member 20 slides along the inner surface 7*a* of the frame 7 while the flange maintains the contact with the surface. The flange 21 accurately follows the movement of the diaphragm 8 so that although there may be dimensional variances in the frame 7 and the ring 10, or the temperature may cause deformation thereof, these variances and distortions are absorbed by the resilience of the sealing member 20. Thus the inner space of the frame 7 can be maintained sealed due to the resilience of the sealing member 20.

Figure 22:
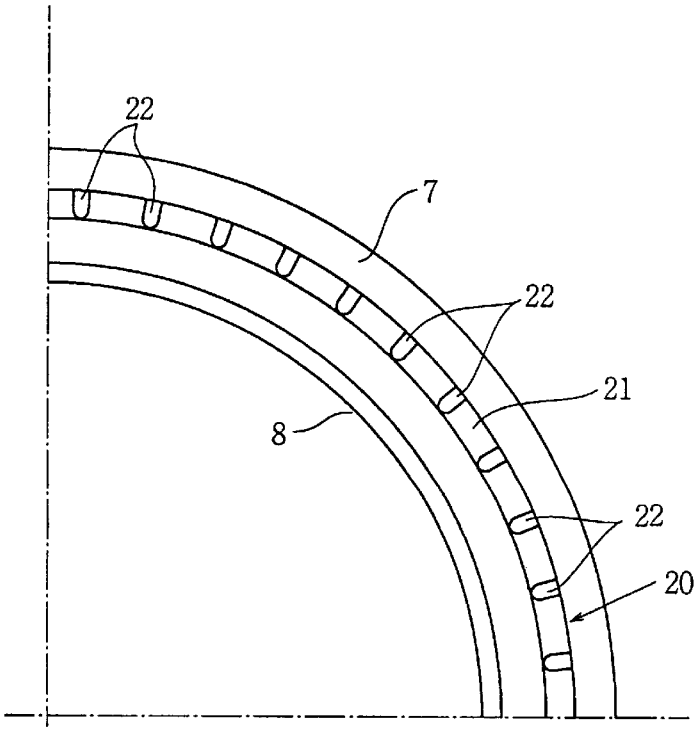
FIG. 22 is a plan view showing a part of a second modification of the sealing member.

Referring to FIG. 22, the sealing member 20 has a plurality of cut out recesses 22 formed in the flange 21 at predetermined intervals. The rigidity of the flange 21 is hence decreased, thereby imparting a sufficient elasticity thereto.

In operation, the flange 21 is urged against the inner surface 7*a* of the frame with increased resilience so that the sealing member 20 moves smoothly. A plurality of slits may be formed instead of the recesses 22.

Figure 23:
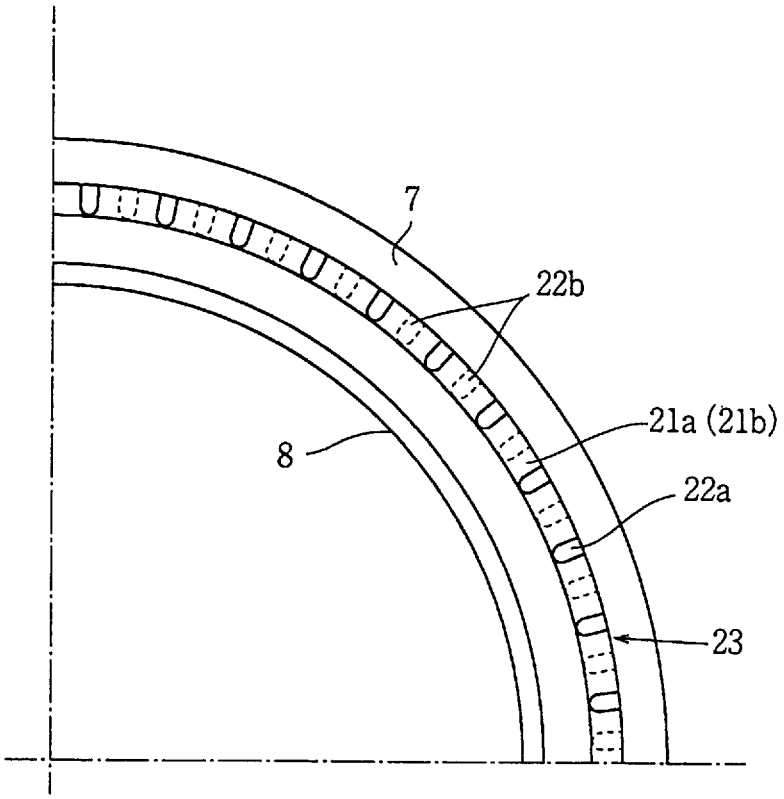
FIG. 23 is a plan view showing a part of a third modification of the sealing member.
Figure 24:
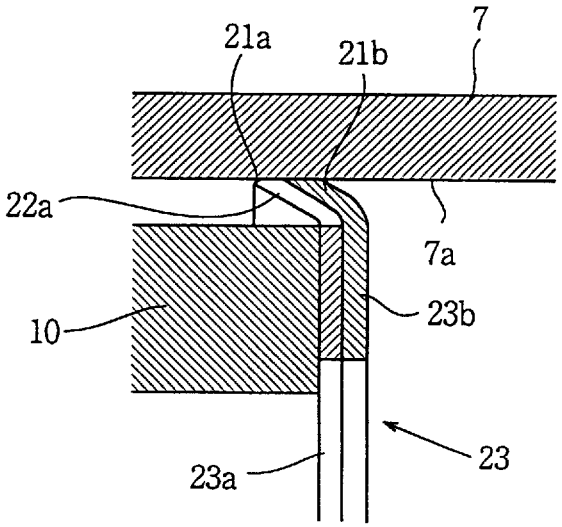
FIG. 24 is a sectional view showing the sealing member of FIG. 23.

FIG. 23 and 24 show another modification of the sealing member. A sealing member 23 comprises an outer layer 23*a* and an inner layer 23*b* each of which are provided with flanges 21*a* and 21*b*, respectively. A plurality of recesses 22*a* are cut in the flange 21*a* and a plurality of recesses 22*b* are cut in the flange 21*b*. The outer layer 23*a* is so mounted on the inner layer 23*b* that the recesses 22*a* of the outer layer 23*a* do not coincide with the recesses 22*b* of the inner layer 23*b*.

Namely, each of the recesses 22*a* and 22*b* is covered by a part of the opposing flanges 21*a* and 21*b* so that the flow of air does not generate. The present modification is advantageous in that, not only is the elasticity of the flange provided, the whistling sound caused by air which flows through the recesses 22 in the example shown in FIG. 22 is further prevented.

The sealing members 11, 20, and 23 are generally adhered on the underside of the ring 10 by an adhesive. However, when the sealing members are made of a porous polymer for the sake of decreasing the weight thereof, the actual area of the sealing member adhered on the ring 10 is reduced. In order to provide enough adhesion, it is necessary to strictly control the nature and the quantity of the adhesive, temperature and the adhesion time. The adhesion process hence becomes a hindrance for easy assemblage, and the improvement of the quality. Moreover, the sealing member may fall from the ring 10 due to the friction between the sealing member and the inner surface of the frame 7.

Figure 25:
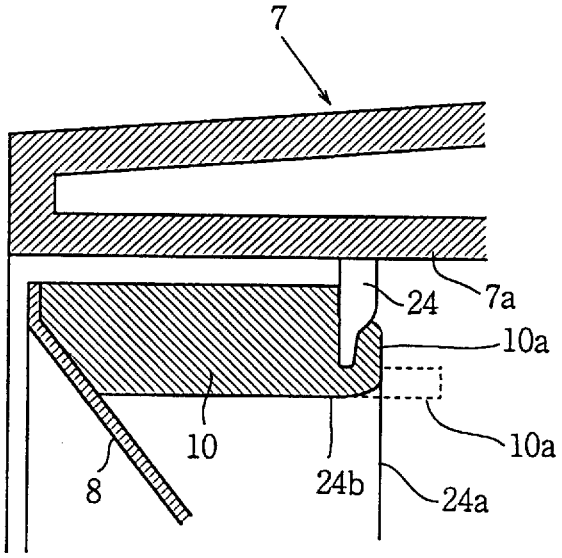
FIG. 25 is a sectional view explaining a method for attaching the sealing member.

FIG. 25 shows a method for attaching a sealing member 24 having an edge 24*a* to the ring 10 wherein the above described problems are solved. Namely, the ring 10 is provided with a projection 10*a* which extends from the inner periphery thereof in the axial direction thereof as shown by a dotted line in FIG. 25. The projection 10*a* is bent in the outward radial direction of the ring 10 so as to hold the edge 24*a* of the sealing member 24 between the projection 10*a* and the bottom of the ring 10.

The projection 10*a* may further be secured to the sealing member 24 by thermocompression bonding. For example, the sealing member 24 is made of a thermoplastic material such as vinyl chloride and polystyrene. The edge 23 is distorted when heated so that the projection 10*a* can be embedded in the edge 23. Hence the sealing member 24 is held by the ring 10 with more strength.

Figure 26:
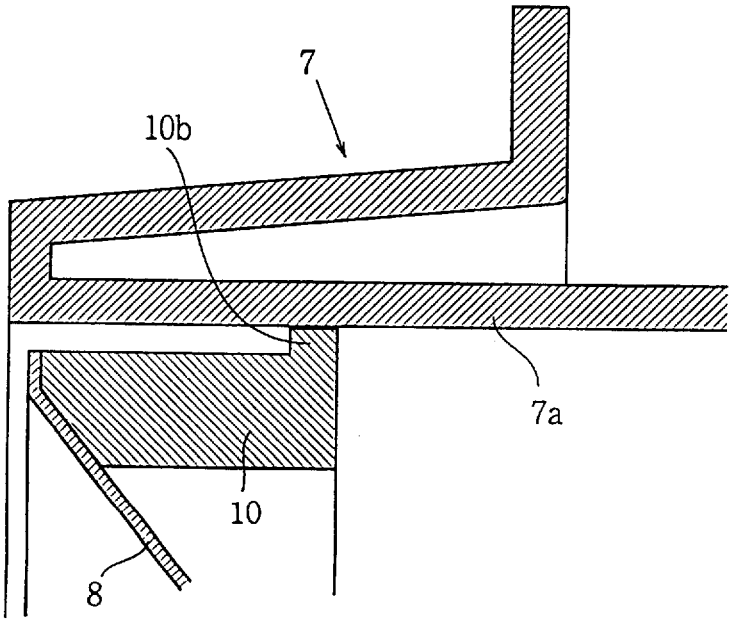
FIG. 26 is a sectional view shows a fourth modification of the sealing member.

Referring to FIG. 26, the sealing member is further is modified so as to be integral with the ring 10. That is to say, the ring 10 has a sealing flange 10*b* along the periphery thereof. In order that the flange 10*b* has a sufficient resilience when sliding along the inner surface 7*a* of the frame 7, the flange 10*b*, or the entire ring 10 is made of an elastic high polymer material.

Since the sealing member is integral with the ring 10, the reaction of the fame 7 exerted on the flange 10 while sliding can be received by the entire ring 10 including the flange 10*b*. Hence the change of contacting pressure of the flange 10*b* is decreased. As a result, the force at which the flange 10*b* engages the inner surface 7*a* is maintained constant, thereby enabling the ring to smoothly slide.

Figure 27:
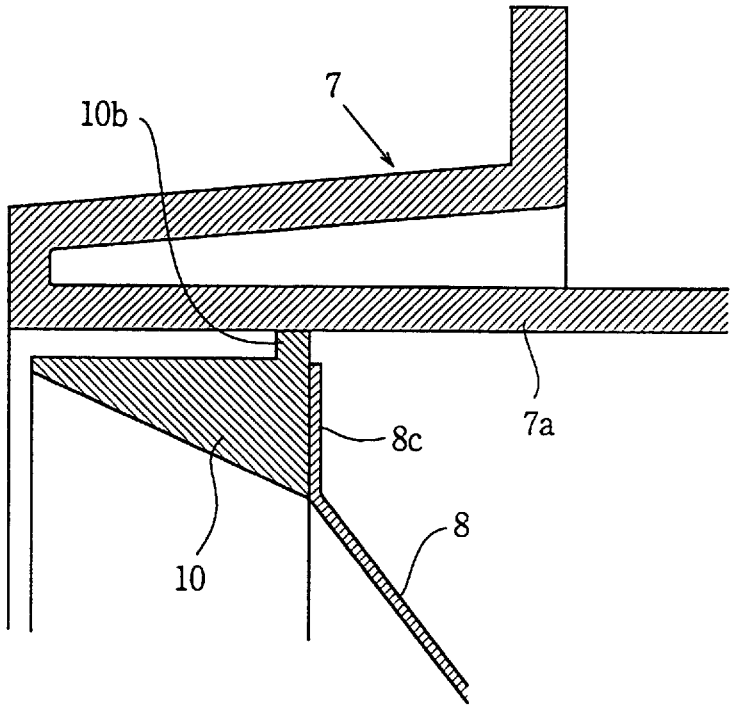
FIG. 27 is a sectional view showing another example of the loudspeaker.

In an example shown in FIG. 27, the ring 10 having the sealing flange 10*b* is provided on a flange 8*c* of the diaphragm 8 adjacent the opening-of the frame 7.

Figure 28:
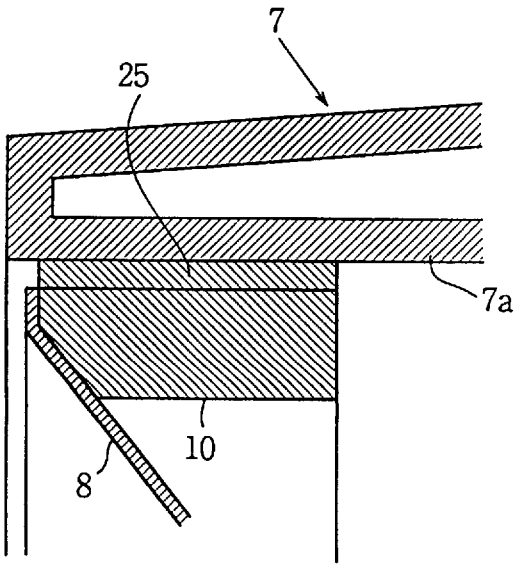
FIG. 28 is a sectional view showing a fifth modification of the sealing member.

Referring to FIG. 28 showing another modification, a sealing member 25 is made from fibrous and porous material such as glass wool and carbon fiber, and has a longer axial length. On the one hand, in order to decrease the friction of the sealing member, it is preferable to set the axial length of the sealing member smaller than the length of a sliding distance thereof. On the other hand, in order to enhance the sealing effect, it is preferable to increase the length of the sealing member as much as possible. If the fibrous and porous sealing member 25 is used, the friction between the sealing member 25 and the inner surface 7*a* of the frame can be decreased while still maintaining the resilience of the sealing member. Hence the surface area of the sealing member 25 which abuts on the frame 7 can be increased, thereby improving the sealing effect without impairing smooth sliding.

Figure 29:
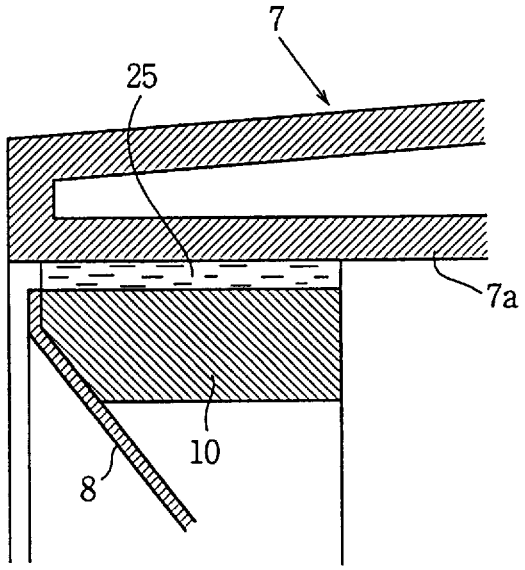
FIG. 29 is a sectional view showing another example of the fifth modification of the sealing member.

It is further preferable to design the sealing member 25 so that the greater portion of the fibers thereof are aligned in parallel to the sliding surface, that is in the sliding direction as shown in FIG. 29. Accordingly, the sealing member 25 is imparted with an appropriate resilience in the direction perpendicular to the sliding direction. As a result, the sealing effect is further improved. At the same time, the sealing member 25 has an appropriate rigidity in the sliding direction thereof, thereby preventing the deformation of the shape.

When the sealing member 11, or any of the herein described sealing member, slides on the inner surface 7*a* of the frame, there may be heard a rustling sound of the sealing member 11 rubbing against the surface. In order to restrain the sound, the inner surface 7*a* is mirror polished to form a smooth surface. However, vacuum is created between contact surface of the sealing member 11 and the extremely smooth inner surface 7*a*. As a result, the sealing member is adhered on the surface by suction so that the smooth sliding thereof cannot be achieved. The speaker performance is hence deteriorated so that the speaker is unreliable.

FIGS. 30 to 34 show means for preventing the suction of the sealing member 11 to the inner surface 7*a* of the frame 7.

Figure 30:
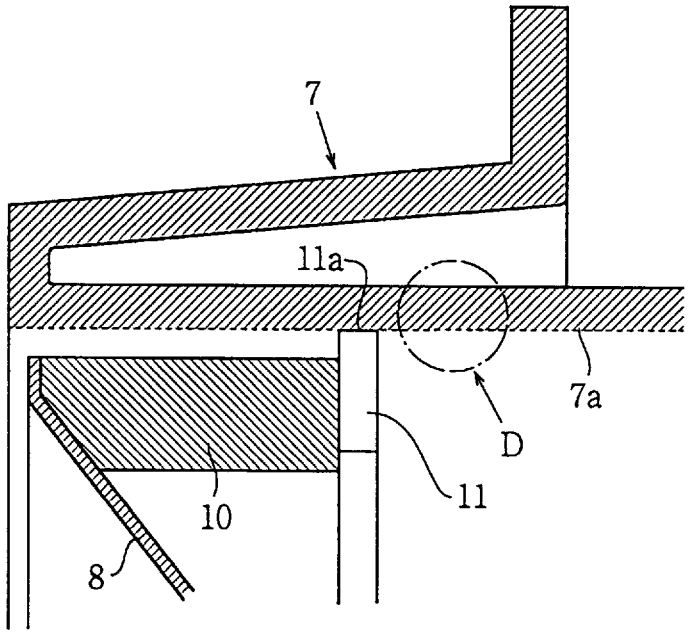
FIG. 30 is a sectional view of a part of the vibrating system of the surroundless loudspeaker showing a modification of a frame.
Figure 31:
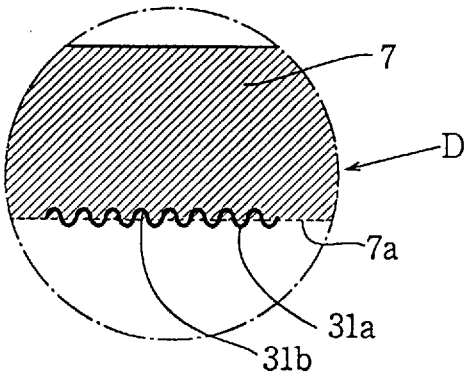
FIG. 31 is an enlarged illustration showing a portion D of FIG. 30.

Referring to FIGS. 30 and 31, on the inner surface 7*a* of the frame 7 are formed a plurality of fine bumps 31*a* and pits 31*b*. The surfaces of the bumps 31*a* are rounded so as to reduce the friction between a contacting surface 11*a* of the sealing member 11 and the surface 7*a*. As a result, an extremely small quantity of air, small enough not to cause deterioration in the reproduced sound, is able to pass through the spaces between the bumps 31*a* and the pits 31*b*. Namely, since vacuum is not generated, it becomes possible to prevent the suction of the sealing member 11 to the inner surface 7*a*. Hence the sealing member 11 is able to smoothly slide on the surface 7*a*.

Alternatively, the bumps and pits may be formed on the contacting surface 11*a* of the sealing member 11, which brings about the same effect as the above described example.

The surface roughness of the inner space 7*a* caused by the bumps 31a and pits 31*b* is preferably in the range of 25 s to 100 s, which is defined in the Japanese Industrial Standard B 0601-1982. It has been shown through the experiments that when the surface roughness is in the herein set range, the suction caused by vacuum between the sealing member 11 and the inner surface 7*a* of the frame 7 is prevented. Thus the rustling of the sealing member sliding does not occur.

More particularly, when the surface roughness is smaller than 25 s, hardly any air passes through the inner surface 7*a* and the contacting surface 111*a* so that vacuum is created therebetween, thereby causing the sealing member 11 to adhere on the surface 7*a* by suction.

When the surface roughness is larger than 100 s, an excessive quantity of air flows through the space between the contacting surface 11*a* and the inner surface 7*a*, thereby causing the undesirable whistling sound. Hence the sound quality of the speaker is deteriorated.

Figure 32:
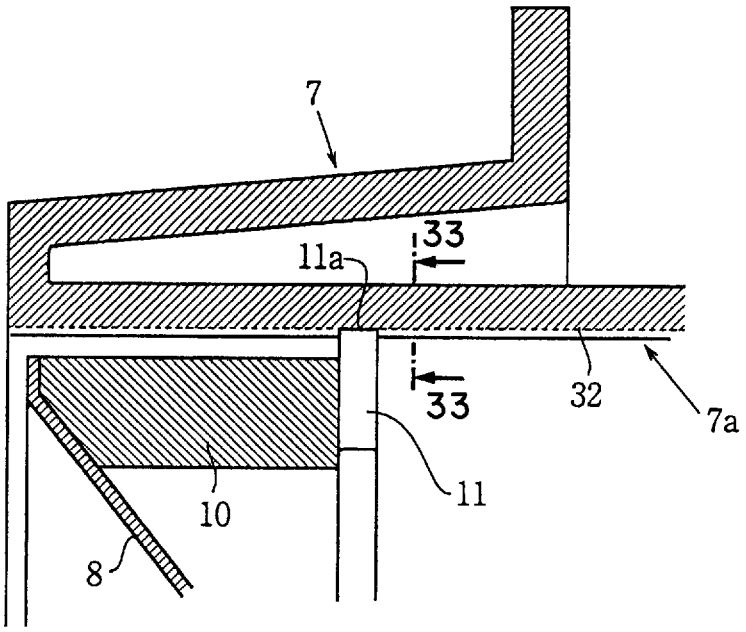
FIG. 32 is a sectional view showing a second modification of a frame provided in the surroundless loudspeaker of the present invention.
Figure 33:
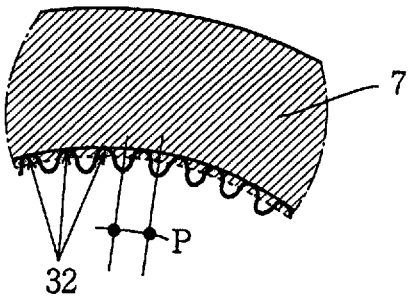
FIG. 33 is a sectional view of the frame taken along the line i—i of FIG. 32

Referring to FIGS. 32 and 33, a plurality of fine axial grooves 32 may be provided on the inner surface 7*a* instead of the bumps and pits. A pitch P of the grooves 32 is in a range of 1 to 3 mm, and the depth of each groove 32 is in a range of 0.2 to 0.3 mm. The ridges between the grooves 32 are rounded so as to decrease the friction between the coating surface 11 and the surface 7*a*.

When the depth of the groove 32 is smaller than 0.2 mm, air cannot pass through the space between the inner surface 7*a* and the contacting surface 11*a*, thereby generated vacuum therebetween. As a result, the sealing member 11 may adhere on the inner surface of the frame 7.

On the other hand, when the depth exceeds 0.3 mm, a large quantity of air flows through the space between the inner surface 7*a* and the contacting surface 11*a*, thereby causing whistling sound, which deteriorate the sound quality.

The fine grooves 32 are formed on the inner surface 7*a* of the frame 7 in the axial direction thereof, that is the sliding direction of the sealing member 11, so that the friction between the inner surface 7*a* and the contacting surface 11*a* is decreased. In addition, spaces are formed between the inner surface 7*a* and the contacting surface 11*a*, thereby allowing a very small quantity of air to flow there-through. As a result, vacuum is not generated between the two surfaces so that the adhesion of the sealing member 11 to the frame due to suction does not occur, thereby enabling the sealing member to slide smoothly.

Figure 34:
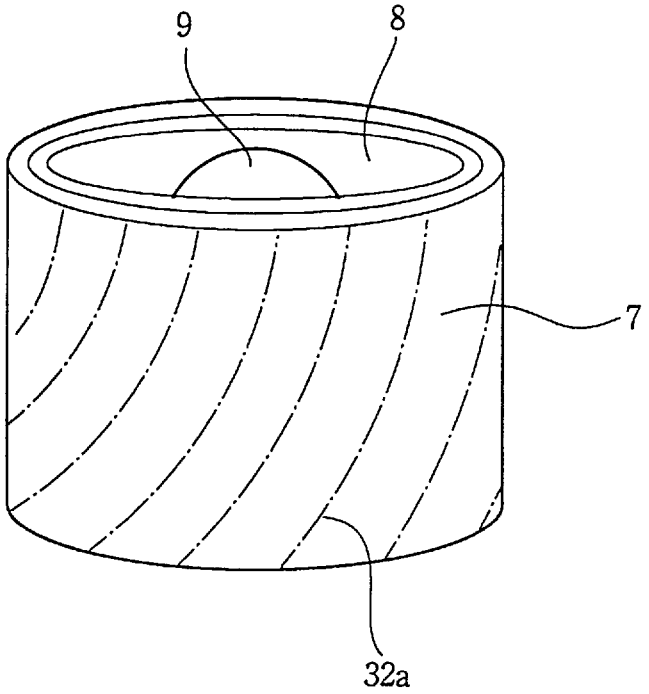
FIG. 34 is a perspective view showing a third modification of the frame.

The grooves 32 provided on the inner surface 7*a* of the frame 7 need not be confined to linear grooves. Instead, as shown in FIG. 34, a plurality of helical grooves 32*a* which run spirally may be formed on the inner periphery of the frame 7. Each helical groove 32*a* covers the distance corresponding to a quarter to a half of the circumference of the frame 7 to ensure that the smooth sliding of the sealing member 11 in the axial direction is not hindered.

Spaces are formed between the inner surface 7*a* and the contacting surface 11*a* for allowing a very small quantity of air to flow there-through, so that vacuum is not generated between the two surfaces. The sealing member 11 is thus prevented from adhering by suction to the frame, thereby enabling the sealing member to slide smoothly.

Lubricant such as wax, grease and oil may be applied on the inner periphery of the frame 7 so as to further decrease the friction between the inner surface 7*a* and the contacting surface of the sealing member 11. Hence the sliding of the sealing member is further enhanced.

More particularly, if the inner surface 7*a* of the frame is flat, the lubricant applied thereon is pushed out of the sliding range by the sealing member 11. However, when applied on the rough surface, the lubricant stays in the pits 31*b* or the grooves 32 and 32*a* within the sliding range. Thus the lubricant is effectively works to decrease the friction so that the sliding characteristic of the sealing member 11 is promoted.

In another example of a sealing means for effectively sealing the inner space in the frame, the inner surface 7*a* of the frame 7 is made of a hard resin and the sealing member 11 of FIG. 1, of a soft resin. In a loudspeaker provided with such a sealing means, when the sealing member 11 resiliently slides on the inner surface 7*a*, a reaction of the frame 7 is constantly exerted on the soft resin sealing member 11, which has a small rigidity. The sealing member 11 is consequently deformed, which results in the deterioration of the speaker performance, and hence the reliability of the speaker.

Figure 35:
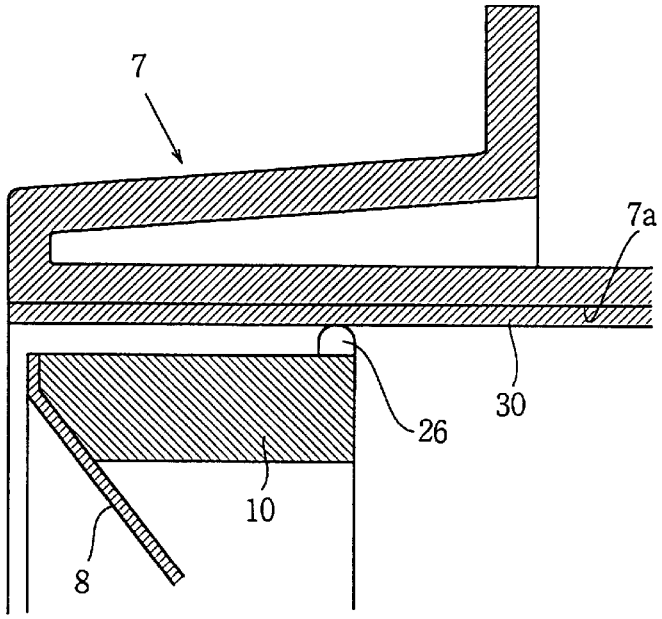
FIG. 35 is a sectional view of a part of the vibrating system showing a fourth modification of the frame.
Figure 36:
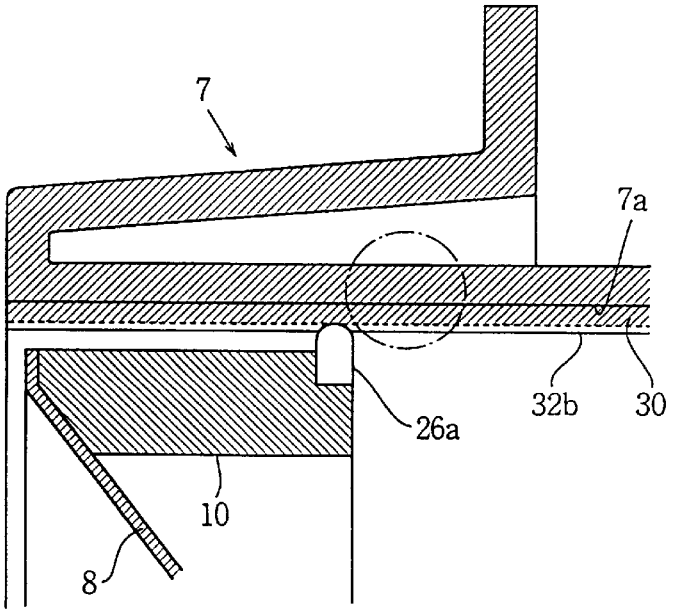
FIG. 36 is a sectional view of a part of the vibrating system showing a fifth modification of the frame.
Figure 37:
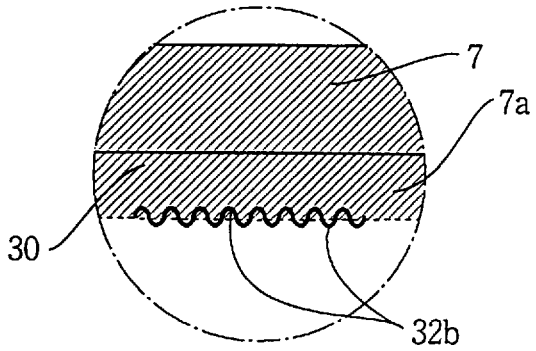
FIG. 37 is an enlarged schematic illustration of the frame shown in FIG. 36.

FIGS. 35 to 37 show modifications of the sealing member and the frame wherein the reliability of the loudspeaker sealing is improved.

Referring to FIG. 35, a sealing member 26 according to the present modification comprises a hard resin such as polypropylene, polyacetal and others. The sealing member 26 is adapted to close the annular space between the ring 10 and the frame 7 so as to seal the inner space of the frame 7. Hence it is possible to prevent the undesired whistling sound which is liable to occur when the diaphragm 8 vibrates and changes the pressure in the cabinet.

The inner surface 7*a* of the frame 7 is coated with a coating layer 30 comprising a soft resin such as silicone rubbers, fluororubbers, and elastonomers.

The sealing member 26 slides on the coating layer 30 in accordance with the vibration of the diaphragm 8. Since the coating layer 30 is made of soft resin, when the sealing member 26 is pressed against the layer 30, although the layer 30 is slightly deflected outwardly toward the frame 7, the resilience of the soft resin renders the layer 30 to push back the sealing member 26. Thus the layer 30 and the sealing member 26 are closely in contact with each other so as not to allow air to pass therebetween. The inner space of the frame 7 is accordingly sealed so that undesirable whistling sound does not generate.

Moreover, even though the sealing member 26 is applied with constant pressure from the frame 7, deformation thereof do not occur due to the material of the sealing member, which is a hard resin. Thus a reliable loudspeaker can be provided.

Referring to FIGS. 36 and 37, the inside wall of the coating layer 30 has a plurality of bumps and pits 32*b*, thereby providing the surface roughness of 25 s to 200 s. Thus the sealing member 26 is prevented from adhering on the coating layer 30 by suction. In place of the bumps and pits, axial grooves may be provided in the same manner as in the example of the sealing means shown in FIGS. 32 and 33.

Moreover, lubricant such as wax, grease and oil may be applied on the surface of the coating layer 30 so as to decrease the friction between the sealing member 26 and the coating layer 30, thereby to improve the slidability.

The surroundless speakers are provided with the outer and inner dampers 6*a* and 6*b* as shown in FIG. 1. Unless two dampers are provided, the bobbin 5 mounted at the center portion of the diaphragm 8, in operation, sways in the radial direction of the loudspeaker, that is, in parallel to the magnetic flux in the gap Gp. The bobbin 5 further bumps against the pole piece 1*a* and the plate 3, thereby generating noise. The two dampers operates to resiliently hold the bobbin 5 to maintain an appropriate vibrating balance.

There must be a sufficient room in the loudspeaker to provide the outer and inner dampers 6*a* and 6*b*. Thus the length of the surroundless speaker cannot be decreased.

The loudspeakers shown in FIGS. 38 to 41 solves the above described problems, thereby enabling to decrease the length thereof without deteriorating the quality of the reproduced sound.

Figure 38:
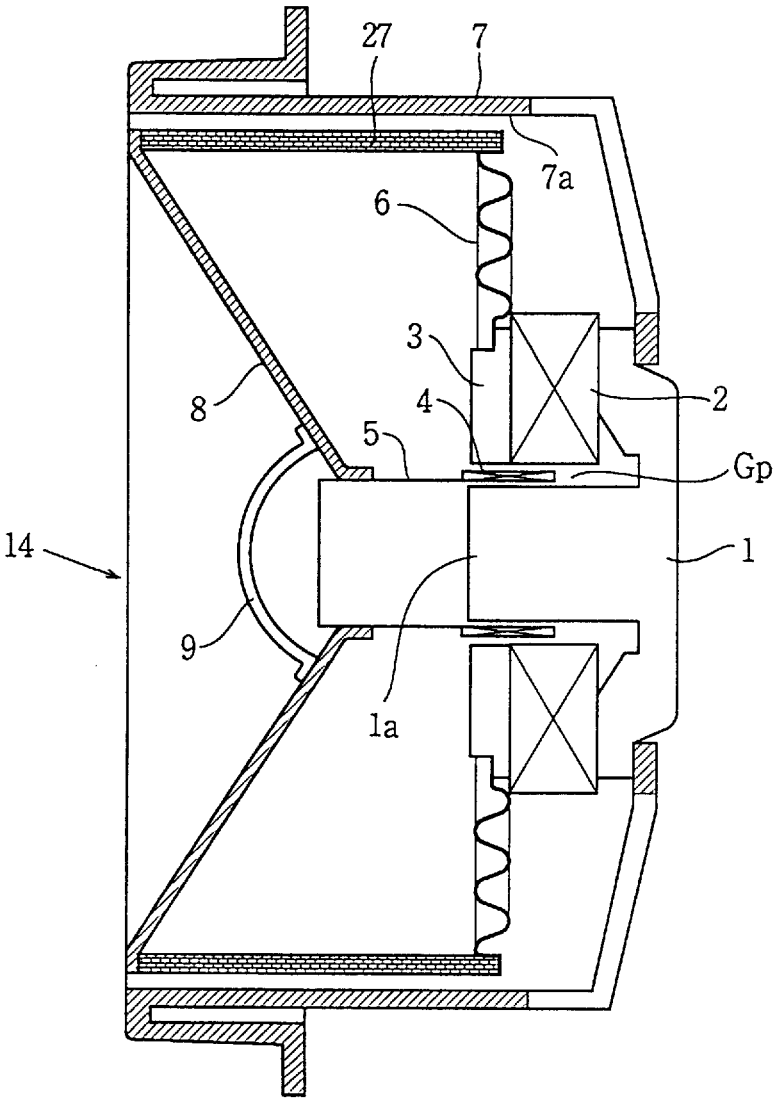
FIG. 38 is a sectional view of an example of the surroundless loudspeaker to which the present invention is applied.

Referring to FIG. 38, the loudspeaker is provided with only one damper 6. A ring 27 having a large length is secured to the outer edge of the diaphragm 8. The inner periphery of the damper 6 attached on the outer periphery of the plate 3, and the outer periphery of the damper is attached on the inside periphery of the ring 27. Thus the ring 27 is resiliently supported by the damper 6.

When the loudspeaker is inoperative, the damper 6 is substantially on the same axial plane as the magnetic gap Gp formed by the plate 3 and the pole piece 1*a*. Thus, the vibrating system 14 is supported in the frame 7 at the position adjacent the magnetic gap Gp where the force for driving the vibrating system 14 is generated.

During the operation, due to the factors such as the change of pressure in the speaker cabinet, the vibrating system 14 is exerted with radial force, that is, in a direction perpendicular to the moving direction of the diaphragm 8, so that the vibrating system is apt to roll. However, since the damper 6 for supporting the vibrating system 14 is positioned on the same plane with the magnetic gap, the rolling can be effectively restrained.

In a loudspeaker where the damper is not provided on the same plane as the magnetic gap, when the vibrating system 14 moves in a direction away from the damper 6, that is to the front of the loudspeaker, the movement is relatively stable even though the radial force is exerted. On the other hand, when moving toward the damper 6, the radial force renders the movement unstable.

To the contrary, in the speaker constructed in accordance with the present modification, the vibrating system 14 moving in any direction is exerted with a force urging the system to move away from the damper 6. Thus the movement of the vibrating system 14 becomes stable. The movement is further rendered stable since the vibrating system 14 cannot be largely deflected from the damper 6.

In operation, when the voice coil 4 is driven, the diaphragm 8 is vibrated. The ring 27 attached to the diaphragm 8 is accordingly moved while maintaining a predetermined distance with the inner surface 7*a* of the frame 7 by resilience of the damper 6. Hence the diaphragm 8 is smoothly vibrated. During the operation, if the voice coil 4 in the magnetic gap Gp is exerted with a radial force, that is, in parallel to the direction of the magnetic flux, the voice coil 4 moves in the radial direction. On the other hand, the damper 6 disposed in the same plane as the gap Gp restrains the radial movement of the voice coil 4. As a result, vibrating balance of the diaphragm 8 attached to the bobbin 5 is kept stable.

The vibrating system 14 is thus resiliently supported with only one damper 6 so that the space for the second damper is no longer necessary. Accordingly, the surroundless loudspeaker with a small axial length can be manufactured.

Figure 39:
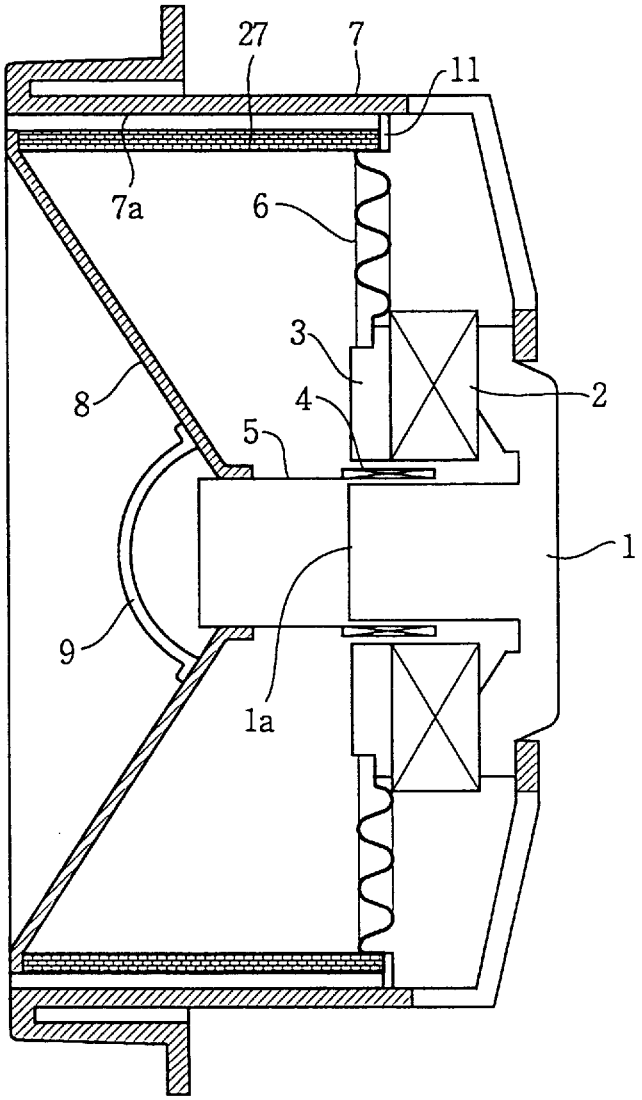
FIG. 39 is a sectional view showing a modification of the loudspeaker of FIG. 39 wherein a sealing member is provided.

Referring to FIG. 39, the surroundless loudspeaker with the single damper 6 is provided with the sealing member 11 provided around the inner edge of the ring 27 as in the loudspeaker of FIG. 1. The sealing member 11 is made of a resilient material such as rubber and foam rubber, or a elastic material such as porous fibers. Hence the space inside the frame 7 is sealed, thereby preventing air from flowing in and out thereof, that is of the cabinet. When the diaphragm 8 vibrates, the sealing member 11 resiliently slides on the inner surface 7*a* of the frame 7. As a result, the whistling sound which is liable to occur when the air passes through the space between the ring 27 and the frame 7, is prevented so that the deterioration in sound quality is restrained.

The sealing member 11 and the frame 7 may be modified in accordance with any of the sealing members shown in FIGS. 21 to 37.

Figure 40:
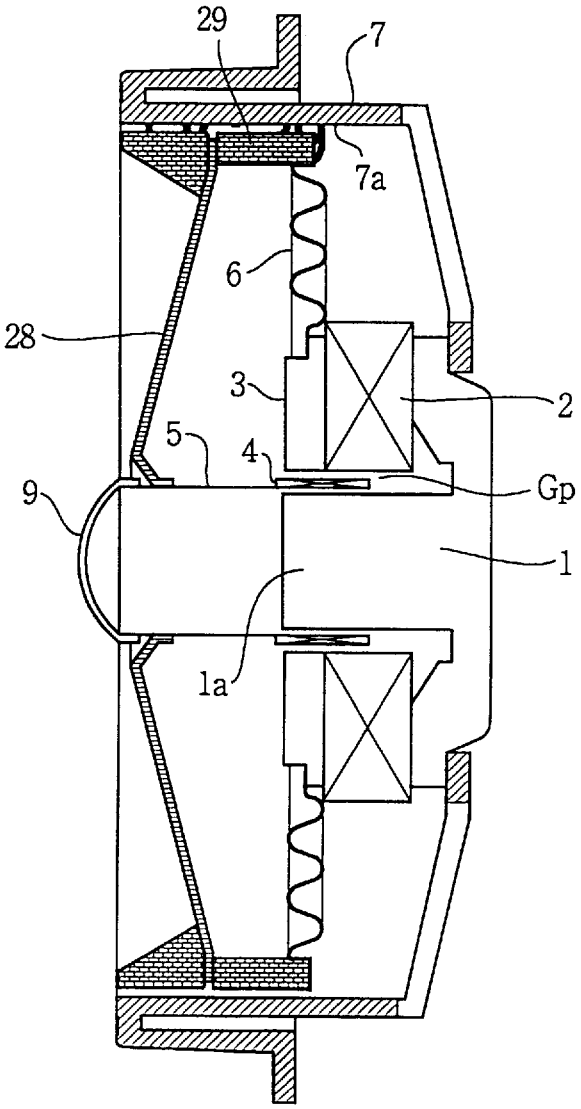
FIG. 40 is a sectional view of another example of the surroundless loudspeaker to which the present invention is applied.

Referring to FIG. 40, the present invention is applied to a loudspeaker having an inverted cone diaphragm 28. Namely, the diaphragm 28 is rearwardly inclined from the center portion to the periphery thereof. Hence the center portion is adjacent to the plane of the front opening of the frame 7. The center cap 9 for covering the center portion of the diaphragm 28 is accordingly disposed outside of the frame 7 and the cabinet. The peripheral edge of the diaphragm 28 is embedded in a ring 29 which is resiliently supported by the damper 6.

In operation, when the voice coil 4 is excited, the diaphragm 28 vibrates as the ring 29 reciprocates. The ring 29 is held by the damper 6 so that the distance between the ring 29 and the inner surface 7*a* of the frame 7 is constant. Hence the diaphragm 28 vibrates without deflecting in the radial direction thereof. If the voice coil 4 which vibrates in the magnetic gap Gp in the axial direction thereof is urged in the radial direction, the voice coil 4, diaphragm 28 and the ring 29 are also urged to move in the same direction. However, the damper 6 restrains generation of the radial movement in the speaker with the inverted cone. Since the periphery of the diaphragm 28 is adjacent the portion of the ring 29 at which the ring is attached to the damper 6 it becomes move effective in preventing the swaying of the diaphragm in the radial direction, that is in perpendicular to the inner surface 7*a* of the frame 7. Hence the diaphragm 28 retains a stable vibrating balance.

It is preferable to modify the loudspeaker of FIG. 40 so as to directly attach the damper 6 to the outer periphery of the diaphragm 28. The swaying of the diaphragm 28 toward the inner surface 7*a* of the frame 7 can be prevented with more reliability, so that the stable vibrating balance of the diaphragm 28 is further ensured.

Figure 41:
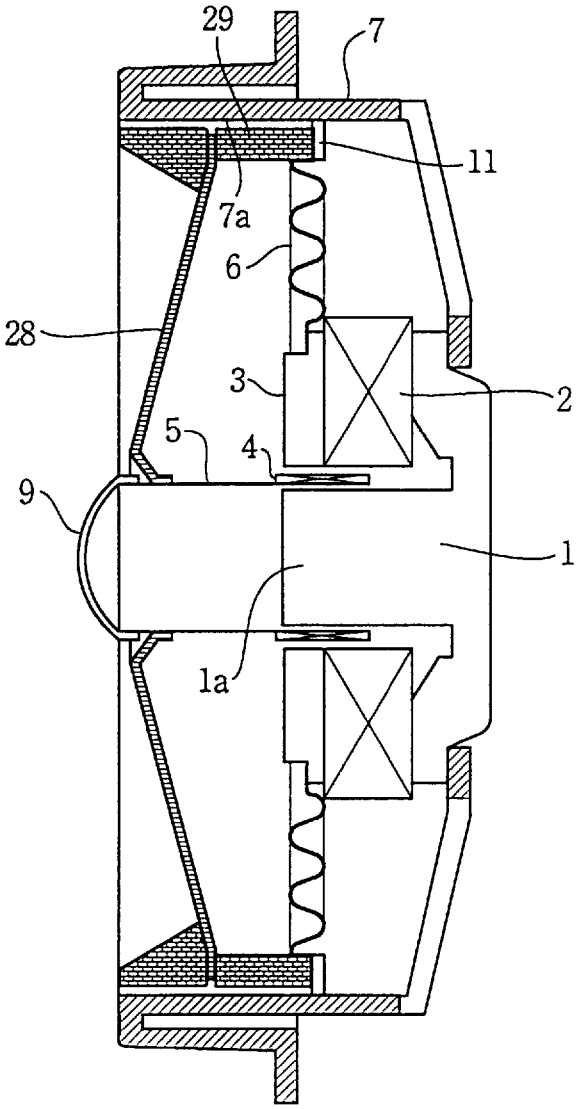
FIG. 41 is a sectional view of a modification of the loudspeaker of FIG. 40 wherein the sealing member is provided.

The loudspeaker of FIG. 40 may be further modified to provide the elastic sealing member 11 on the inner edge of the ring 29 on the same plane as the damper 6 as shown in FIG. 41. When the loudspeaker is operated, the sealing member 11 slides on the inner surface 7*a* of the frame 7, resiliently contacting with the surface. Thus, the vibration of the diaphragm 28 does not cause air to flow through the space between the ring 29 and the frame 7. The undesired whistling sound hence does not occur, thereby preventing the deterioration of the reproduced sound quality.

Figure 42:
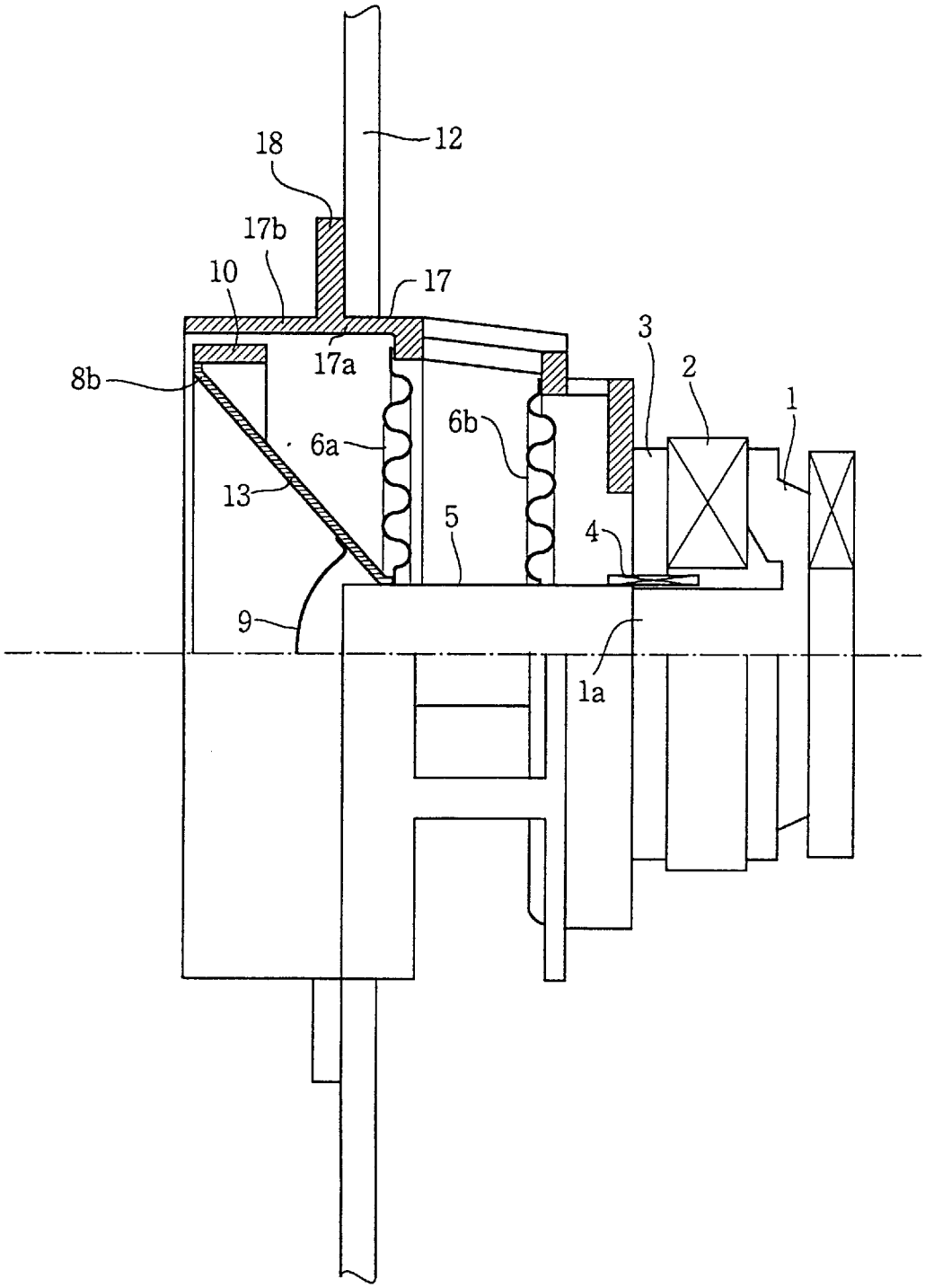
FIG. 42 is a sectional view showing another example of the surroundless loudspeaker to which the present invention is applied.
Figure 43:
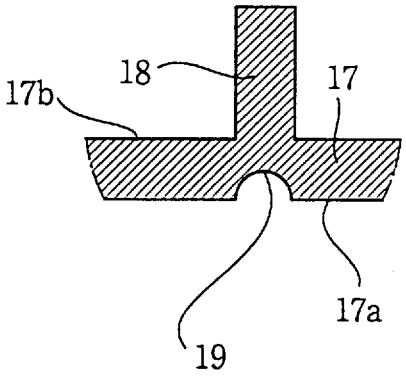
FIG. 43 is an enlarged view of the loudspeaker of FIG. 42 showing the frame thereof.

Referring to FIG. 42, some surroundless loudspeakers are provided with a frame 17 having a simple construction comprising a cylindrical body 17*b* a flange 18 provided on the outer periphery of the body 17*b*. The flange 18 is securely attached to the front surface of the cabinet 12 with screws. If the frame 17 is made of resin, which can be easily molded, there is formed a circumferential sink 19 shown in FIG. 43 on an inner surface 17*a* of the frame 17 along a joint of the flange 18 and the body 17*b*. The sink 19 is caused by a tension or a surface tension in the stretching direction of the resin when hardened. The sink 19 extends along the circumference of the body 17*b* in a direction perpendicular to the sliding direction of the sealing member 11, so that when the sealing member 11 slide, it may catch in the sink 19. Hence the sealing member 11 cannot smoothly slide on the inner surface 17*a* of the frame thereby causing a fall in sound quality.

Moreover, after the frame 17 is mounted in the cabinet 12, the weight of the magnetic circuit comprising the yoke 1, magnet 2 and the plate 3, which is relatively heavy, is exerted on the frame 17, causing deformation thereof. The sealing member 11 cannot keep the appropriate contact with the inner surface 17*a* of the deformed frame. The sliding operation of the sealing member 11 therefore becomes uneven. As a consequence, the sound quality is drops.

The frame 7 provided in the hereinbefore described surroundless speakers do not cause such problems, and is described in detail with reference to FIGS. 44 to 48.

Figure 44:
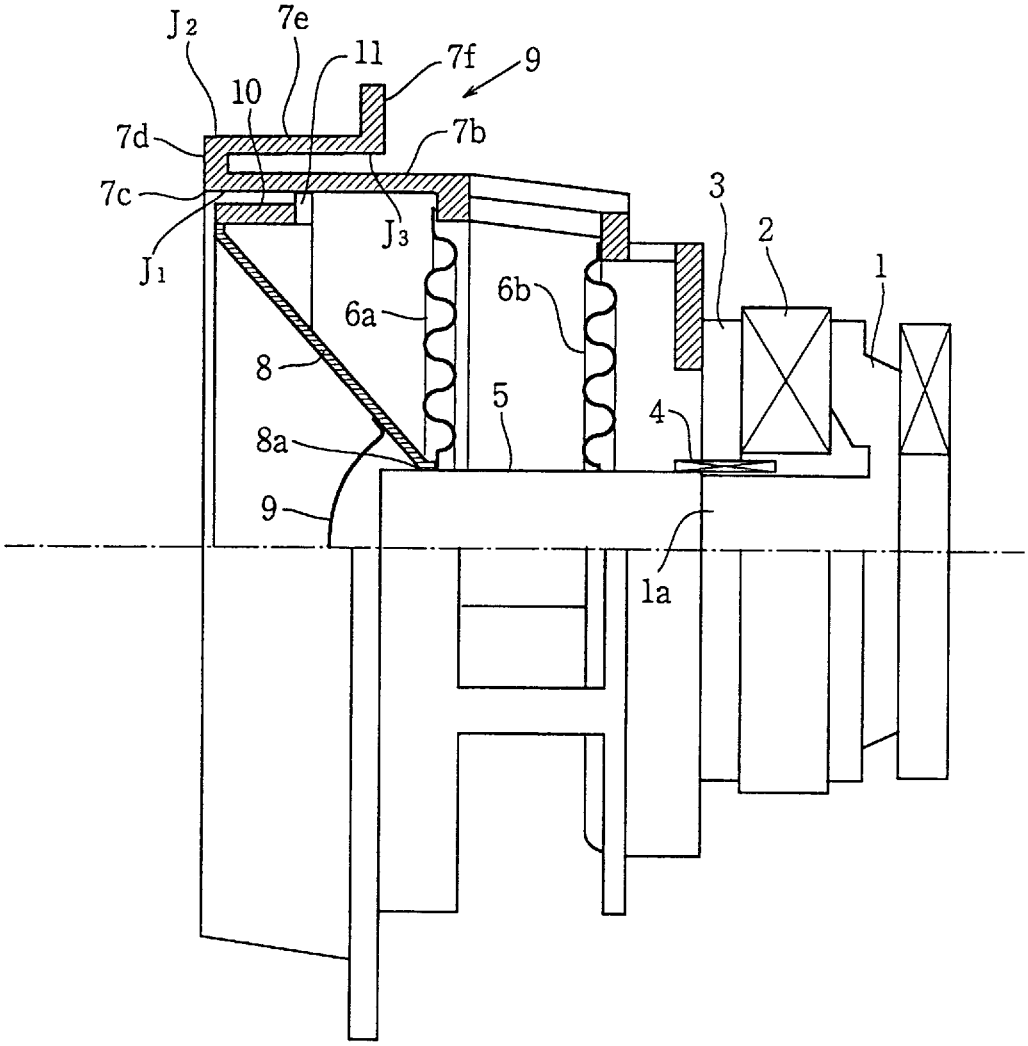
FIG. 44 is a sectional view of the loudspeaker showing a modification of the frame.

Referring to FIG. 44, the frame 7 made of resin comprises a cylindrical body 7*b* having the inner surface 7*a* and an outer cover 7*e* coaxial with the body 7*b* and connected thereto through an annular connecting flange 7*d* with a gap therebetween. An outside flange 7*f* is formed around the rear periphery of the outer cover 7*e*.

In thus molded frame 7 where various parts are integrally formed, sinks are formed at joints $J_1$, $J_2$ and $J_3$ where the body 7*b* joins the connecting flange 7*d*, where the connecting flange 7*d* joins the outer cover 7*e*, and where the outside flange 7*f* joins the outer cover 7*e*, respectively. The sinks at the joints $J_2$ and $J_3$ are not on the inner surface 7*a* of the body 7*b* so that they do not affect the sliding movement of the sealing member 11. The sink at the joint $J_1$, although formed on the inner surface 7*a*, is located adjacent an inner front edge 17*c* of the body 17*b* outside the reach of the sealing member 11. Hence the sealing member 11 is free of the influence of the sink.

Figure 45:
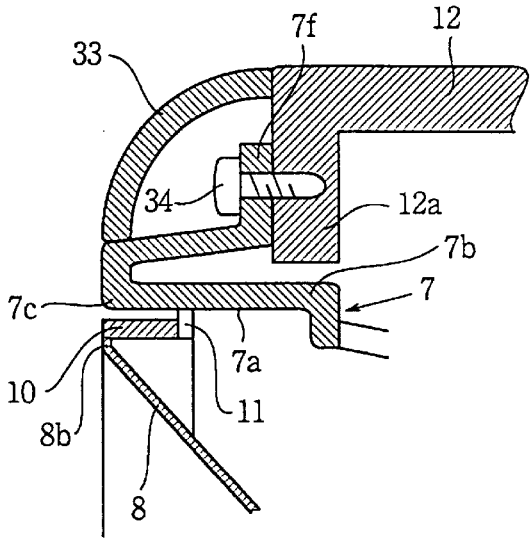
FIG. 45 is an enlarged sectional view of the frame of FIG. 44 when mounted in the loudspeaker.

As shown in FIG. 45, the frame 7 is mounted on the cabinet 12. The flange 7*f* is attached on a front surface of a wall 12*a* of the cabinet 12 which serves as a baffle. The frame 7 is then secured to the cabinet 12 through screws 34. A sub-baffle 33 is further mounted on the cabinet surrounding the frame 7.

If the diaphragm 8 is so mounted on the frame 7 as to position the outer periphery 8*b* thereof at an inner position apart from front edge 7*c*, there is formed a space within the inner surface 7*a* outside the diaphragm 8. The sound waves generated in accordance with the vibration of the diaphragm 8 are diffracted as they pass by the inner front edge 7*c* and expands. Consequently, sound pressure is decreased, resulting in deterioration of sound quality. It is hence preferable to position the outer periphery 8*b* of the diaphragm adjacent the inner front edge 7*c*. More preferably, the outer periphery 8*b* of the diaphragm 8 is positioned on the same plane with the inner front edge 7*c*.

Figure 46:
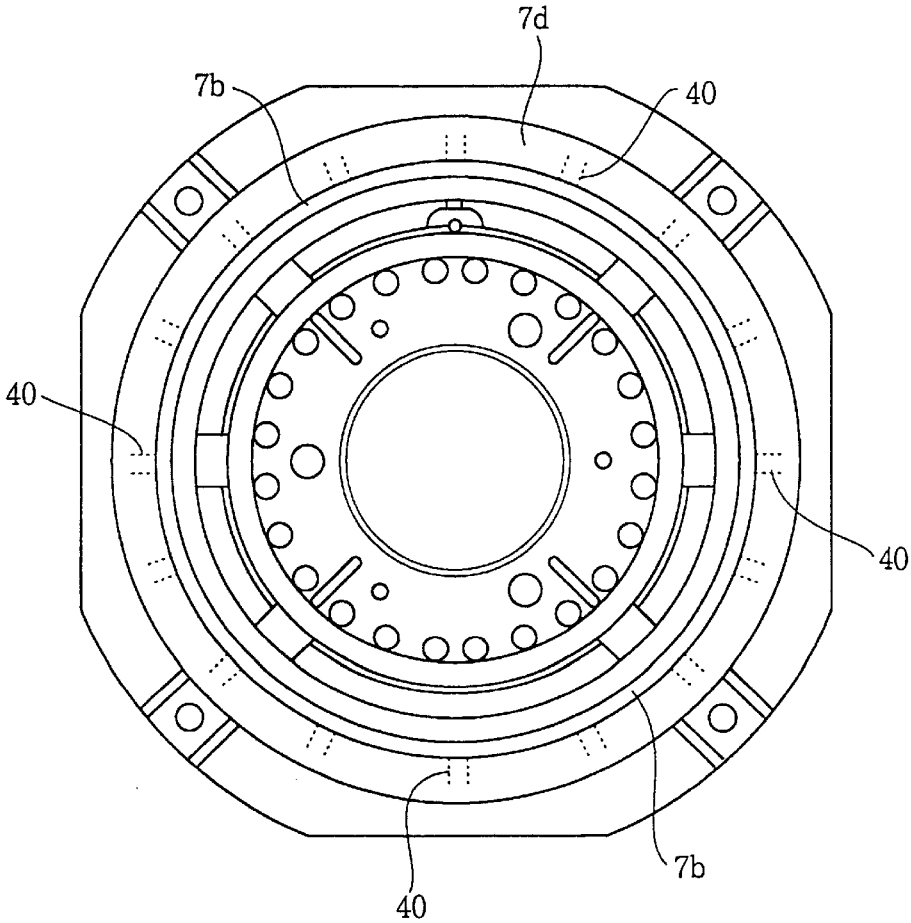
FIG. 46 is a front elevational view showing another modification of the frame.
Figure 47:
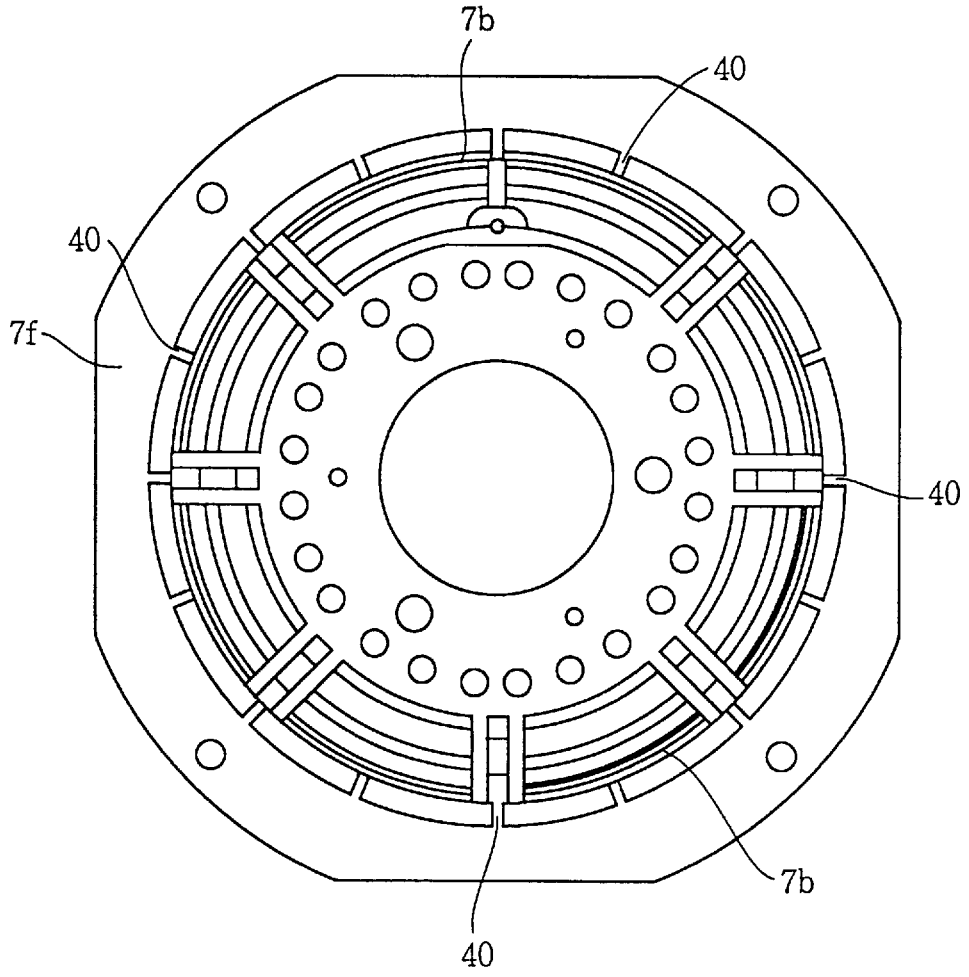
FIG. 47 is a rear elevational view of the frame of FIG. 46.
Figure 48:
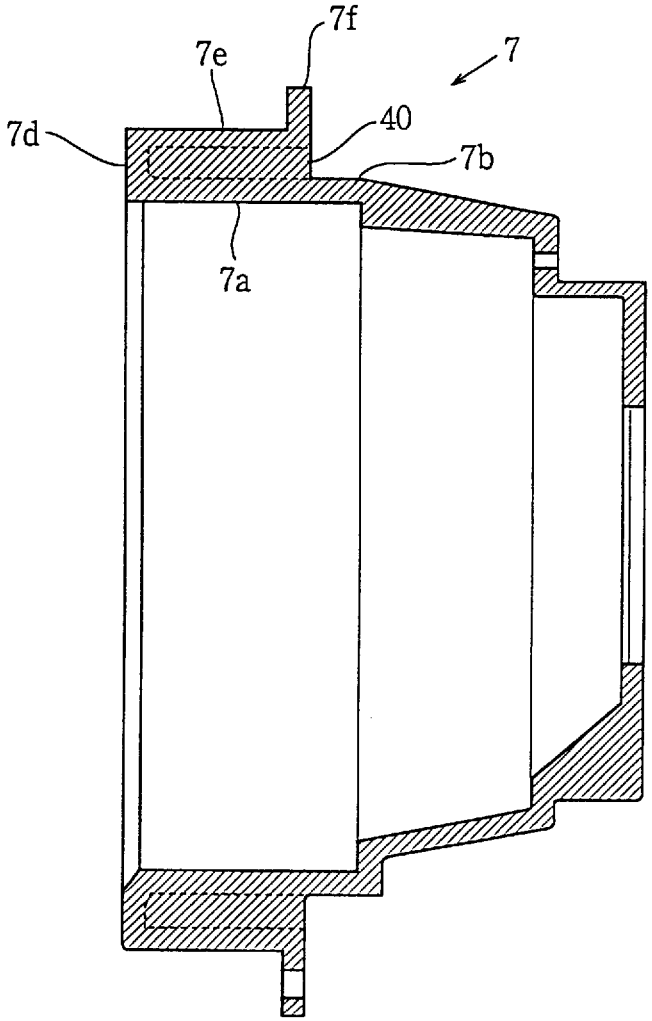
FIG. 48 is a sectional view of the frame of FIG. 46.

Referring to FIGS. 46 to 48, the frame 7 may be provided with a plurality of radial narrow ribs 40 to increase the rigidity of the frame 7. Each rib 40 is formed integral with the body 7*b* and the outer cover 7*e* and positioned therebetween. The body 7*b* and the outer cover 7*e* hence becomes integral so that the rigidity of the frame 7 is increased.

Although the ribs 40 cause sinks to be formed on the inner surface 7*a* at the back of the ribs, the sinks are formed in the axial direction of the frame 7, that is in the sliding direction of the sealing member 11. The sinks accordingly does not hinder the sliding movement of the sealing member 11.

To the contrary, these sinks may be advantageous in ensuring the smooth sliding. Since each rib 40 is so narrow that the area of the sink is extremely small. The narrow sinks provide the same effects as the pits and grooves provided in the frame 7 described with reference to FIGS. 30 to 34. Namely, a very small quantity of air is allowed to pass through the space between the inner surface 7*a* and the sealing member 11. Hence the adhesion of the sealing member 11 to the frame 7 due to suction is prevented.

The ribs 40 thus improves the rigidity of the cylindrical body 7*b* so that the frame is not deformed in spite of the heavy magnetic circuit held therein. The body 7*b* of the frame 7 is prevented from being deflected so that the sealing member 11 resiliently abuts against the inner surface 7*a* thereof so as to smoothly slide.

The sealing members provided in the surroundless speakers of the present invention are preferably provided on the rear edge of the ring as shown in the figures. The reason is explained hereinafter.

Figure 49:
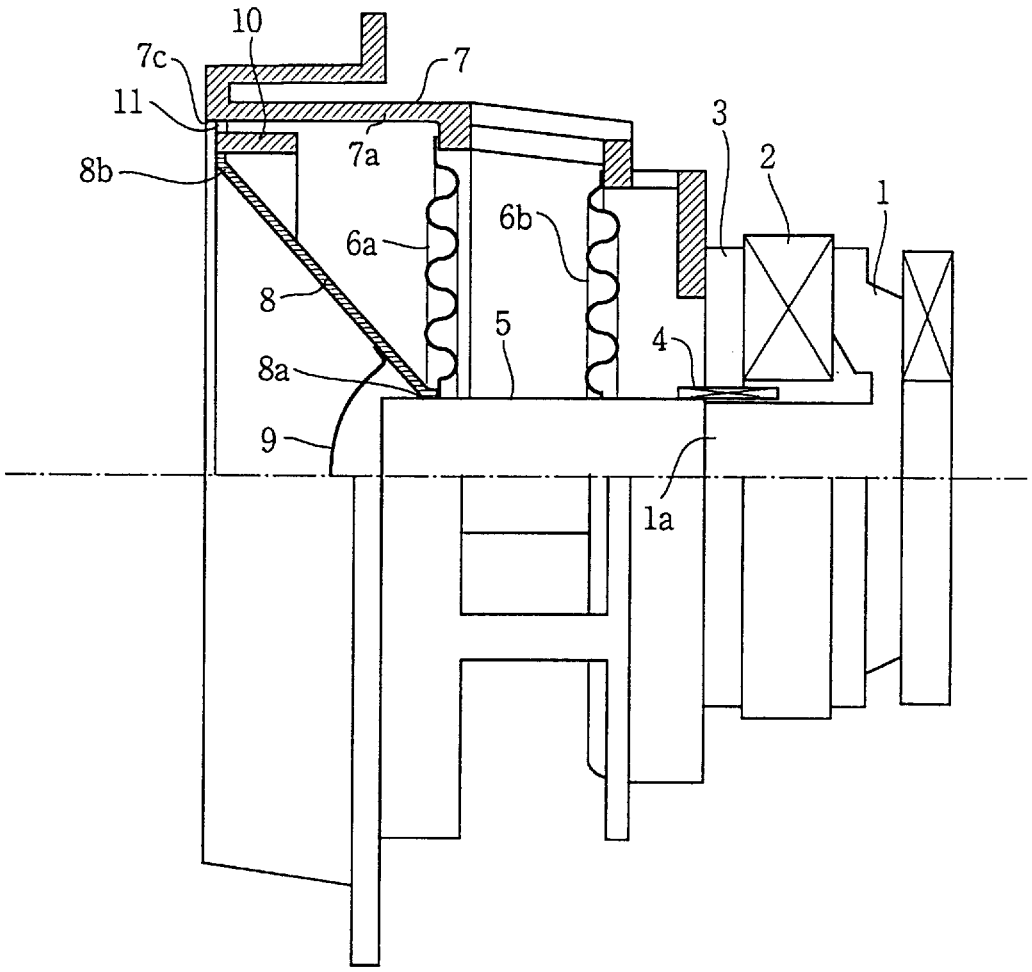
FIGS. 49 and 50 are sectional views of other examples of the surroundless loudspeaker of the present invention showing various arrangements of diaphragms.

Referring to FIG. 49, the sealing member 11 is provided around the front periphery of the ring 10. When the sealing member 11 and the ring 10 vibrates in accordance with the vibration of the diaphragm 8, the sealing member 11 may eject out of the frame 7 during operation. The sealing member 11 may catch by inner front edge 7*c* of the frame 7 upon re-entry therein. As a result, the diaphragm 8 stops vibrating.

Figure 50:
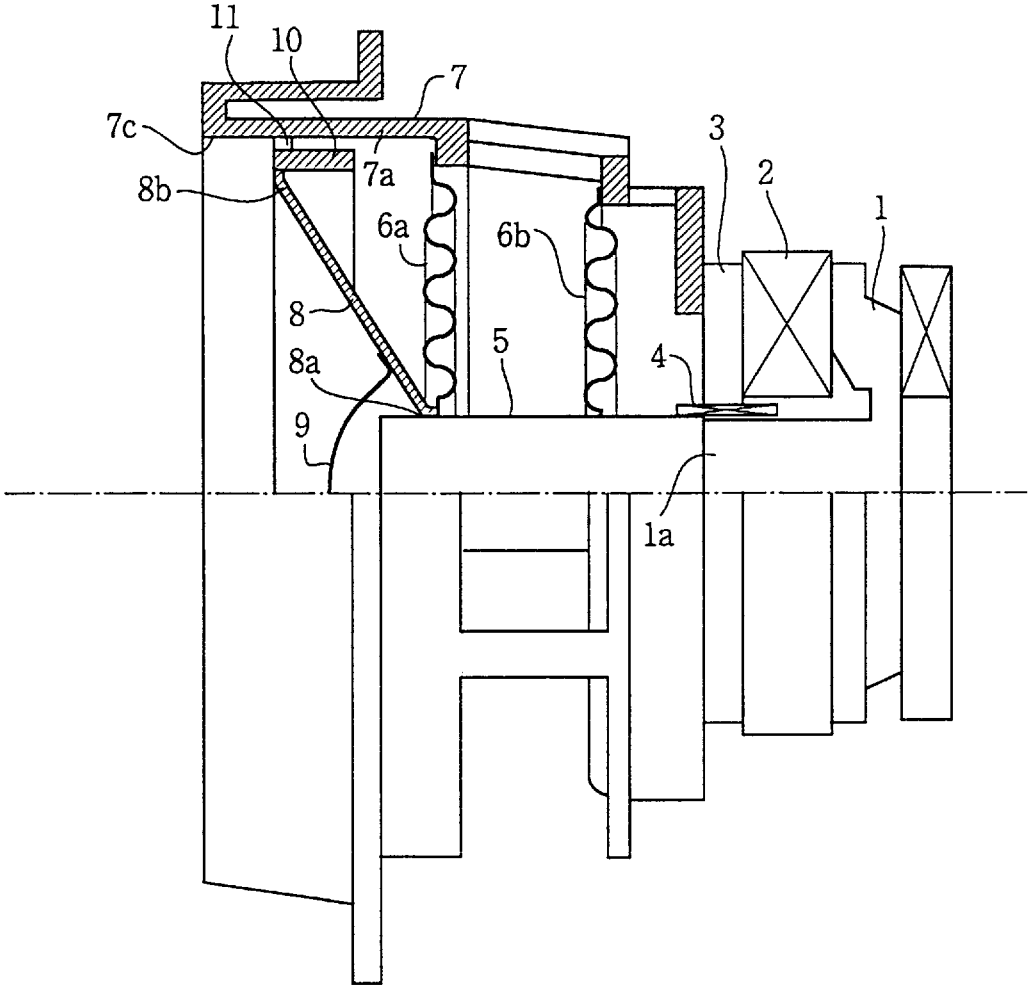

In order to resolve the problem, the position of the diaphragm 8 is determined in consideration to the maximum stroke thereof. More particularly, as shown in FIG. 50, the diaphragm 8 is so positioned at the rear of the opening of the frame 7 that there is no danger of the sealing member 11 projecting out of the frame 7. However, in such a construction, a space is formed in the frame 7 in front of the diaphragm 8 as described above with respect to FIG. 45. The space causes diffraction and hence the expansion of the sound waves, resulting in the decrease of the sound pressure. The sound quality is hence deteriorated, as described hereinbefore.

Thus it is advisable to position the diaphragm 8 so that the outer periphery 8*b* thereof is substantially in the same plane as the front surface of the frame 7 as shown in FIG. 44. The outer end of the ring 10 is secured to the outer periphery 8b of the diaphragm 8, and the sealing member 11 is provided on the opposite end of the ring 10, namely at an innermost position of the ring 10.

Thus, even when the diaphragm is moved the maximum stroke so that the outer periphery 8*b* projects out of the frame 7, the sealing member 11 stays therein. The diaphragm 8 can hence be smoothly moved. Furthermore, only a small space is formed in the frame 7 in front of the diaphragm so that the diffraction of the sound waves is prevented.

The suction of the sealing member 11 to the inner surface 7*a* of the frame 7 is liable to occur when the inner surface is mirror polished for the sake of increasing slidability of the sealing member 11. The problem can be solved by selecting an appropriate material for the sealing member 11.

In the sealing member made of the porous material, air can flow through the sealing member 11 so that the adhesion of the sealing member 11 to the frame 7 due to suction can be prevented. The quantity of air is small enough so as not to cause the deterioration of sound. Moreover, the porous material is advantageous in that despite its large resilience, the friction thereof is small when sliding, and furthermore, light in weight. Hence the smoothness with which the sealing member 11 slides on the inner periphery 7*a* is increased.

The sealing member 11 may be made of porous fiber to obtain the same effect as the sealing member of porous material.

The sealing member 11 may further be modified so that the porous resin or the porous fiber consisting the sealing member absorbs lubricant such as wax, grease and oil. Namely, the porous material can hold a large quantity of lubricant in the pores thereof so that the slidability of the sealing member 11 can be satisfactorily maintained.

The sealing member 11 is made of a material of a semi-closed cell foam so that the absorptive property thereof is increased.

Figure 51:
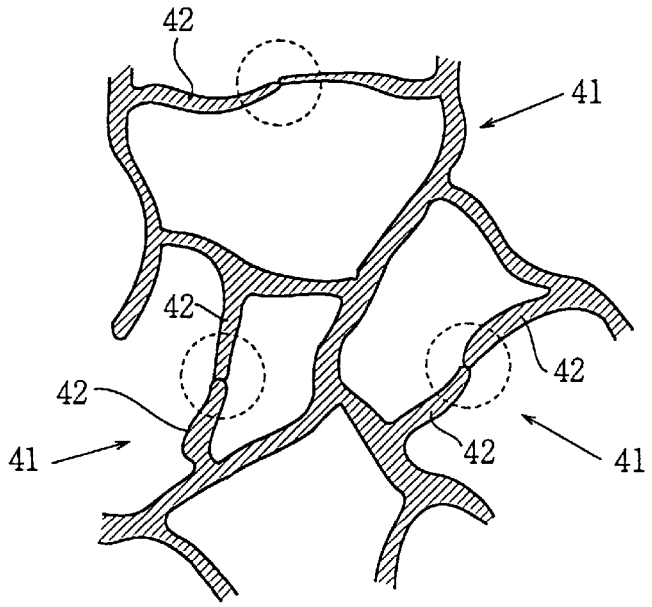
FIG. 51 shows a semi-closed cell foam used as the sealing member of the present invention.
Figure 52:
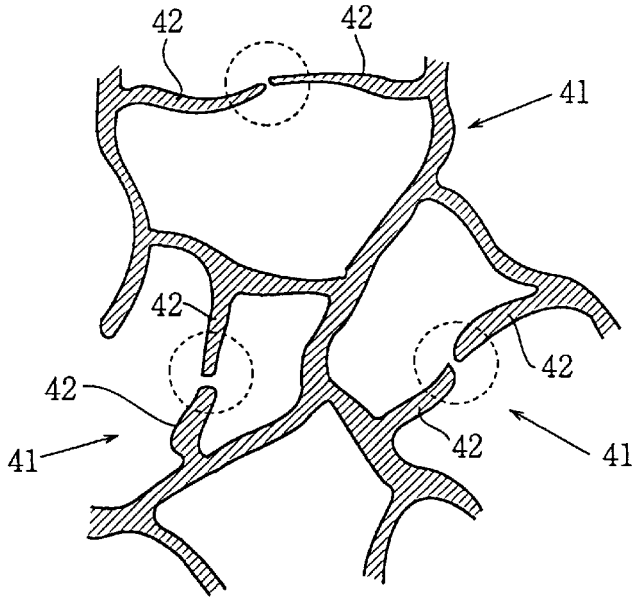
FIG. 52 shows the semi-closed cell foam of FIG. 51 in operation.

Referring to FIG. 51, the semi-closed cell foam comprises a plurality of closed cells 41, each sharing walls 42 thereof with the adjoining cells. When applied with appropriate pressure, joints of walls are broken as shown in FIG. 52 so that the adjoining cells 41 are communicated with one another. Thus the lubricant can be absorbed in the cells 30 even in the inner portion of the sealing member 11 while the foam is compressed. When the pressure is relieved, the walls 42 of the cells 41 are again closed.

In operation, the sealing member 11 receives reaction of the frame 7 as the sealing member slides on the inner surface 7*a* of the frame 7. When the sealing member is thus applied with appropriate pressure, walls 42 of the cells 41 of the semi-closed cell foam are broken so that the lubricant in the cells 30 gradually leaks out toward the outer surface of the sealing member 11. As a result, the sliding surface is lubricated. When the pressure is relieved, the walls 42 are closed to render each cell 41 closed, isolated from the other cells. Thus the lubricant can be securely held in the sealing member 11.

If the sealing member 11 is made from a closed cell foam, the lubricant does not flow between the cells. The lubricant cannot reach the outer surface of the sealing member where the lubricant is required, although the sealing member 11 may be soaked with the lubricant.

In a case where the open cell foam is used as the sealing member 11, the cells are constantly communicated with each other so that the lubricant vaporizes. The lubricant accordingly cannot be sufficiently maintained.

It is preferable to use grease as the lubricant. The reason is that the grease is not volatile as oil and hence, is less apt to lose the quantity thereof for a longer period of time. On the other hand, it is difficult to apply wax on the surface of the sealing member and to saturate it therein. Moreover, since the wax does not ooze out to the outer surface of the sealing member 11, it is difficult to keep the outer surface thereof lubricated during the life of the loudspeaker. Thus the diaphragm 8 cannot be smoothly vibrated.

In addition, the grease lubricant fills in spaces on the outer surface of the sealing member 11 to render the surface smooth and even. Accordingly, the sealing effect of the sealing member is increased. Furthermore, the grease has a high viscosity so that it is possible to restrain the vibration of the frame 7 and the sealing member 11.

Thus, in accordance with the modification, the sealing member 11 is compressed by the reaction of the frame 7 during operation so that the lubricant held therein gradually oozes out. As a result, the outer surface of the sealing member 11 and the inner surface 7*a* of the frame 7 are maintained sufficiently lubricated so that the sealing member 11 can smoothly slide for a longer period of time.

Figure 53:
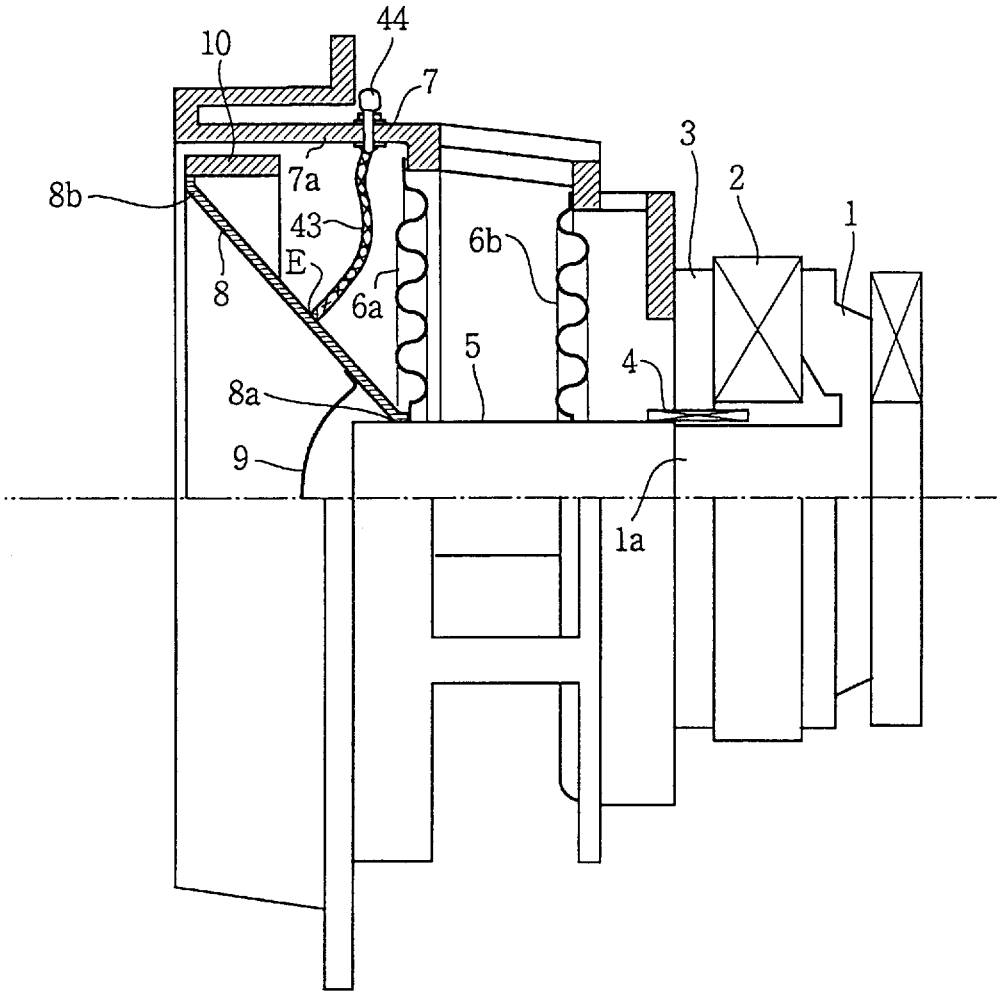
FIGS. 53 and 54 are sectional views of the surroundless loudspeaker of the present invention, each showing a lead provided therein.

Referring to FIG. 53, in general, the voice coil 4 wound around the bobbin 5 is extended to reach a point E on the back of the diaphragm 8. One end of a lead 43, usually a tinsel cord, is connected to the extension of the voice coil 4 at the point E through an eyelet (not shown). The other end of the lead 43 is connected to a terminal 44 mounted on the frame 7.

In the surroundless speaker where the distance within which the diaphragm 8 moves is large, it may happen that the back of the diaphragm 8 touches the lead 43 upon vibration. In addition, it is necessary to provide a longer lead 43 than loudspeakers with the surrounds so that the diaphragm may be moved freely. However, such a provision increases the possibility of the diaphragm making a contact with the lead 43, thereby decreasing the quality of the reproduced sound.

Figure 54:
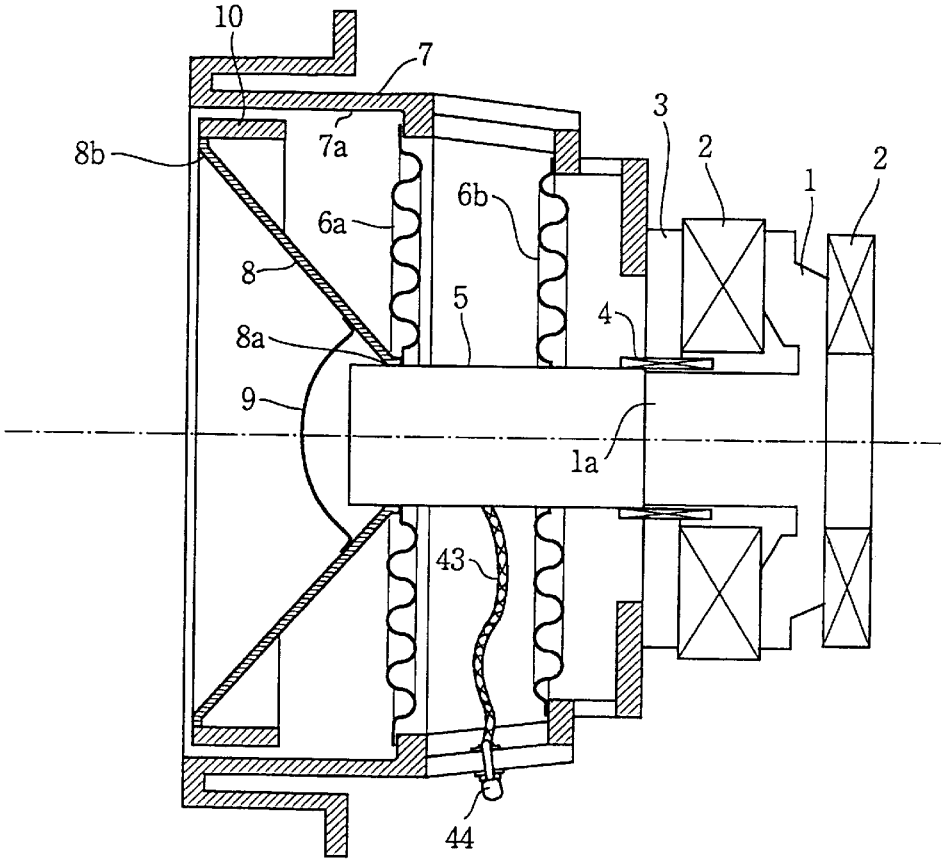

In order to prevent such a contact of the diaphragm 8 with the lead 43, as shown in FIG. 54, the voice coil 4 is connected to the lead 43 at a position on a periphery of the bobbin 5 between the dampers 6*a* and 6*b*. The terminal 43 is provided on the periphery of the frame 7 also between the dampers 6*a* and 6*b*.

In operation, since the lead 43 is disposed in a space between the dampers 6*a* and 6*b*, the diaphragm 8 does not touch the lead 43. Thus the deterioration of the reproduced sound does not occur.

The space between the dampers 6*a* and 6*b* can be increased as appropriate so that it is possible to prevent the lead 43 from making a contact with either of the dampers. Even if the lead 43 should touch the dampers 6*a* and 6*b*, such a contact of the lead causes much smaller deterioration of sound than the contact with the diaphragm 8.

In the surroundless speakers with double dampers, it is necessary for the dampers to keep the vibrating system well balanced. In order that the vibrating system is smoothly advanced or retracted a maximum stroke from an inoperative state, the balance of the vibrating system must be maintained. If the balance is violated, the vibrating system cannot be smoothly moved, thereby lowering the sound quality.

Figure 55:
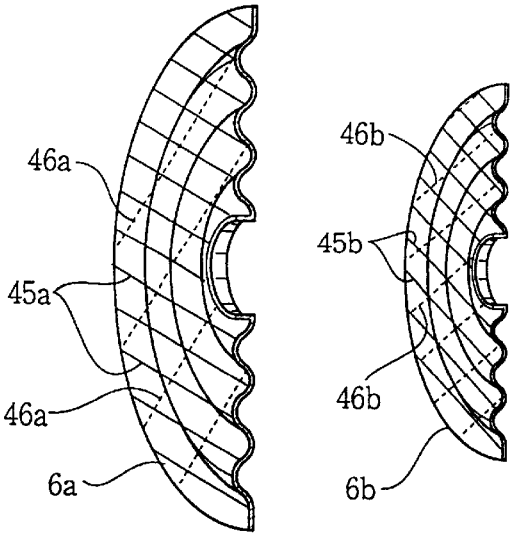
FIGS. 55 and 56 are fragmentary views of outer and inner dampers made of textiles, provided in the surroundless loudspeaker of the present invention.

FIG. 55 shows the outer and inner dampers 6*a* and 6*b* intended to maintain the appropriate balance of the vibrating system. The dampers 6*a* and 6*b* shown in FIG. 55 are made of cloth such as cotton, comprising warps 45*a*, 45*b* shown by solid lines, and wefts 46*a*, 46*b* shown by dotted lines, respectively, interwoven with each other. The densities of the warp and weft per unit length usually differ. For example, as shown in the figure, the warps 45*a* and 45*b* are densely woven while the wefts 46*a* and 46*b* are loosely woven.

The densely woven warps 45*a* and 45*b* have more bending strength than the loosely woven wefts 46*a* and 46*b*. When the dampers 6*a* and 6*b* are so positioned that the warps 45*a* and 45*b* thereof are oriented in the same direction, the strength in the direction of the warps and the strength in the direction perpendicular thereto becomes unequal. As a result, the dampers 6*a* and 6*b* are apt to fluctuate in a certain direction during operation, so that the vibrating system cannot be supporting with an even balance.

In the present invention, the dampers 6*a* and 6*b* in FIG. 55 are so disposed that the direction of the warps 45*a* of the outer damper 6*a* do not coincide with the warps 45*b* of the inner damper 6*b*. Since the direction at which the warps of the damper 6*a* are densely woven differ from that of the damper 6*b*, the direction at which the bending strength is large is not confined to one direction. Thus the overall bending strength of the dampers 6*a* and 6*b* becomes even, so that the vibrating system is supported with resilience from any direction.

Figure 56:
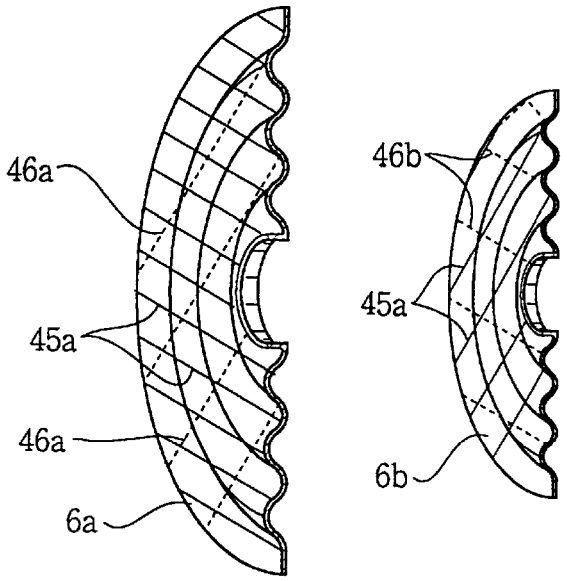

Referring FIG. 56, the relative position of the dampers 6*a* to the damper 6*b* may be determined so that the direction of the closely woven warp 45*a* of the outer damper 6*a* coincides with the direction of the loosely woven weft 46*b* of the inner damper 6*b*. Thus the direction of the larger bending strength of one damper coincides with the direction of the smaller bending strength of the other damper thereby combining the larger and smaller bending strengths. The overall bending strength of the dampers accordingly becomes even.

Due to the relative positions of the dampers with regard to other parts and problems caused by a manufacturing method, the outer and inner dampers 6*a* and 6*b* of the surroundless speaker inevitably have different diameters. When the material and the shape of the dampers 6*a* and 6*b* are the same, the compliance characteristics thereof differ from each other due to the difference in diameters. For example, as shown in FIG. 54, the outer damper 6*a* has a larger diameter than the inner damper 6*b*. The compliance of the inner damper 6*b* with the smaller diameter is smaller than that of the damper 6*a* with the larger diameter. As a consequence, the inner damper 6*b* becomes a vibration load on the vibrating system so that a good vibrating balance thereof cannot be maintained, which results in a decrease of the sound quality.

Figure 57:
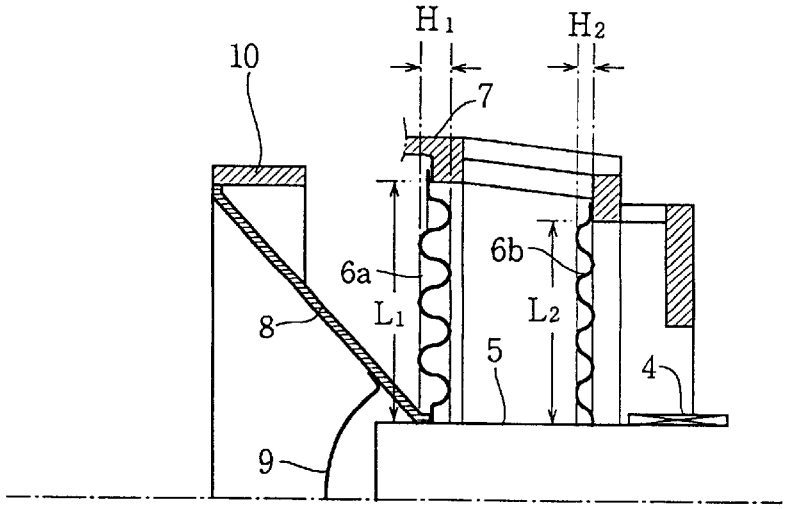
FIGS. 57 to 59 are sectional views of the vibrating systems provided in the surroundless loudspeaker of the present invention, showing the dampers in various dimensions.

Referring to FIG. 57, in order to render the compliance characteristics of the dampers 6*a* and 6*b* substantially the same, the dimensions of the dampers are designed as follows.

$$L_1 > L_2$$

$$H_1 > H_2$$

where $L_1$ and $L_2$ are the diameters of the outer and inner dampers 6*a* and 6*b* respectively, and the $H_1$ and $H_2$ are the heights of the corrugations of the dampers 6*a* and 6*b* respectively.

Namely, by decreasing the height $H_2$ of the damper 6*b*, the compliance characteristic thereof is increased so as to become approximate to the compliance characteristic of the other damper 6*a*. The vibrating system can hence be appropriately supported without loosing balance.

Figure 58:
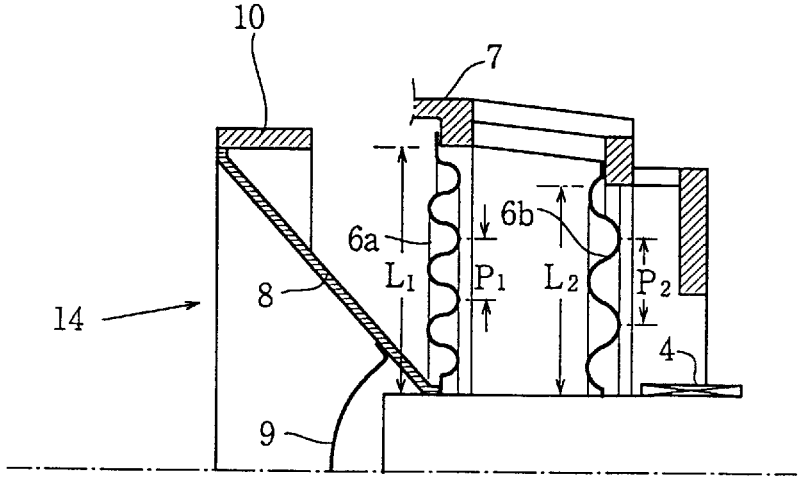

Referring to FIG. 58, the dampers 6*a* and 6*b* are dimensioned in accordance with the following equations.

$$L_1 > L_2$$

$$P_1 < P_2$$

where $P_1$ and $P_2$ are pitches of the corrugations of the dampers 6*a* and 6*b*, respectively.

Since the pitch $P_2$ of the inner damper 6*b* is increased, the compliance thereof is increased. Hence the vibrating system 14 can be supported by the dampers while maintaining the balance while vibrating.

Figure 59:
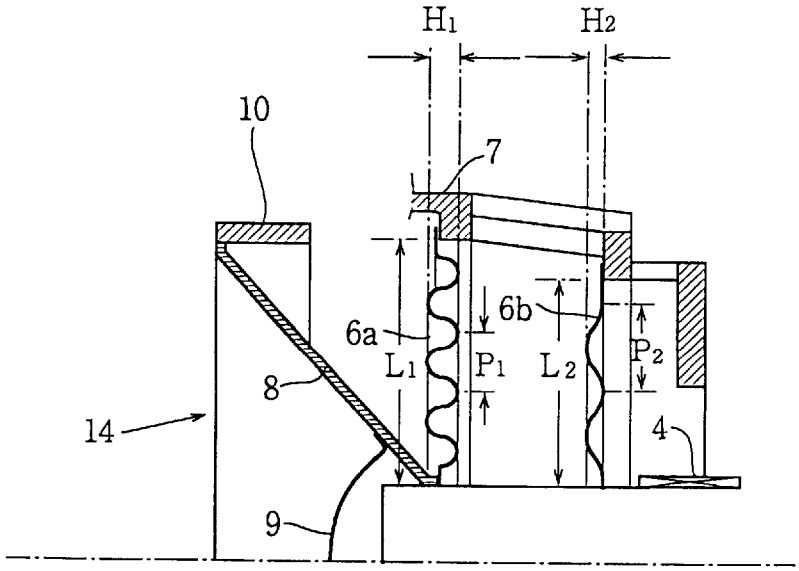

Referring to FIG. 59, the dampers 6*a* and 6*b* may be dimensioned in accordance with the following equations.

$$L_1 > L_2$$

$$H_1 > H_2$$

$$P_1 < P_2$$

Namely, the height $H_2$ and the pitch $P_2$ of the corrugations of the inner damper 6*b* are rendered smaller than those of the outer damper 6*a*. Thus, the compliance characteristic of the inner damper 6*b* is adjusted more precisely so as to approximate the compliance characteristic of the outer damper 6*a* more accurately. Thus the vibrating system 14 becomes free of vibrating load so that the balance thereof is maintained.

The compliance characteristic of the inner damper 6*b* may be substantially conformed with that of the outer damper 6*a* by using different material for each damper. More particularly, if the outer damper 6*a* is made of cloth as described above, the inner damper 6*b* is made of a polyester film, which has a large compliance. The inner damper 6*b* may further be a butterfly damper made of metal or bakelite. Alternatively, cloth may be used for the inner damper 6*b* provided that the concentration of a thermosetting resin which is saturated therein at molding differs from that for the outer damper 6*a*, thereby increasing the compliance of the inner damper 6*b*. Hence the compliance characteristics of the dampers are approximated. The vibrating system 14 becomes free of vibrating load so that the balance thereof is maintained.

Figure 60:
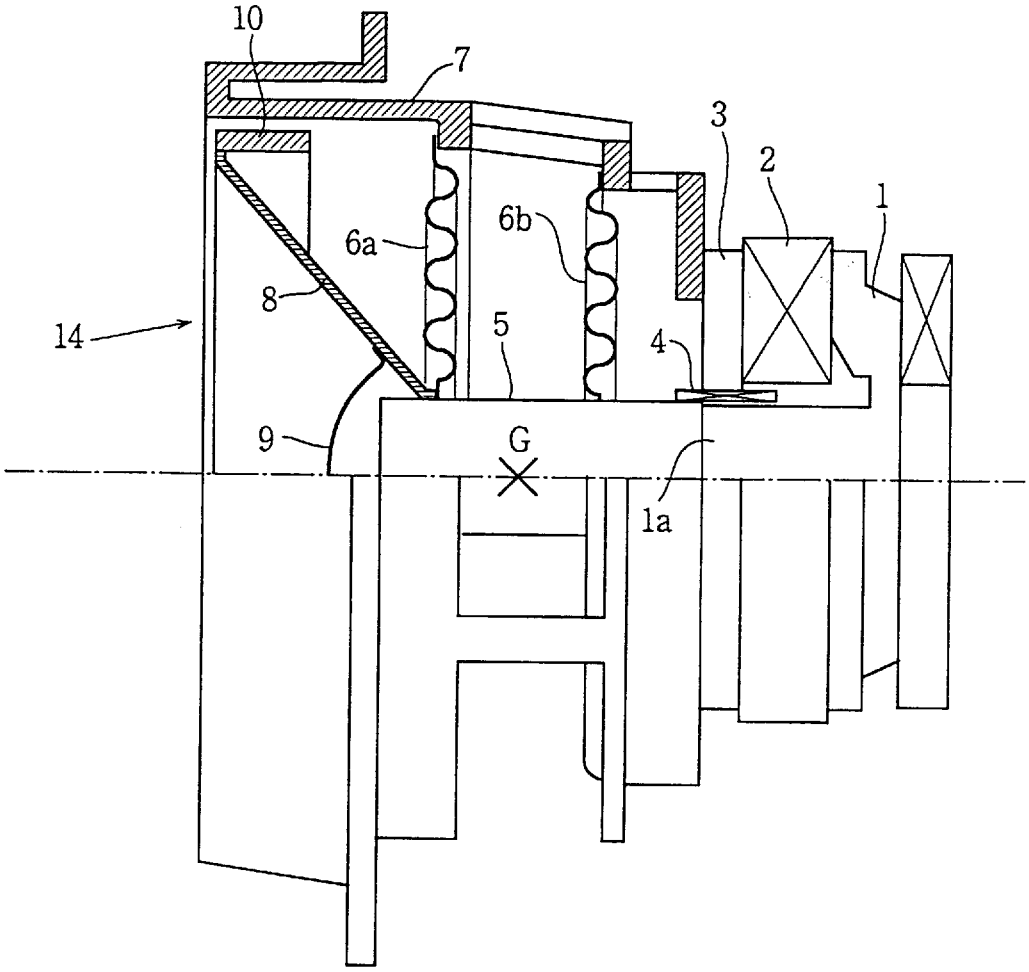
FIG. 60 is a sectional view of the surroundless loudspeaker of the present invention showing the location of the center of gravity of the vibrating system thereof.

The vibrating system of the surroundless loudspeaker is apt to roll during operation. The rolling occurs when the vibrating system moves a maximum distance from the inoperative state in the vibrating system which is not well-balanced, and hence the movement thereof is not smooth. In order to prevent such a rolling phenomenon, in addition to approximating the compliance characteristics of the dampers as described above, it is advisable to manufacture the vibrating system 14 so that the center G of gravity thereof shown in FIG. 60 is located at a midpoint substantially equidistant from the dampers 6*a* and 6*b* in axial direction of the system when inoperative. When the center G of gravity is located at the midpoint, the combined supporting characteristics of the dampers 6*a* and 6*b* becomes substantially the same as that of a single damper.

For example, supposing that the compliance characteristics of the outer and inner dampers are substantially the same, if the center G of gravity of he vibrating system 14 is displaced from the center point between the dampers 6*a* and 6*b*, the vibrating system is unstable even when inoperative. The vibrating system becomes even more unstable during operation, thereby causing rolling.

To the contrary, the vibrating system 14 having the center G of gravity at the axial center between the dampers 6*a* and 6*b* can be smoothly moved without rolling.

Figure 61:
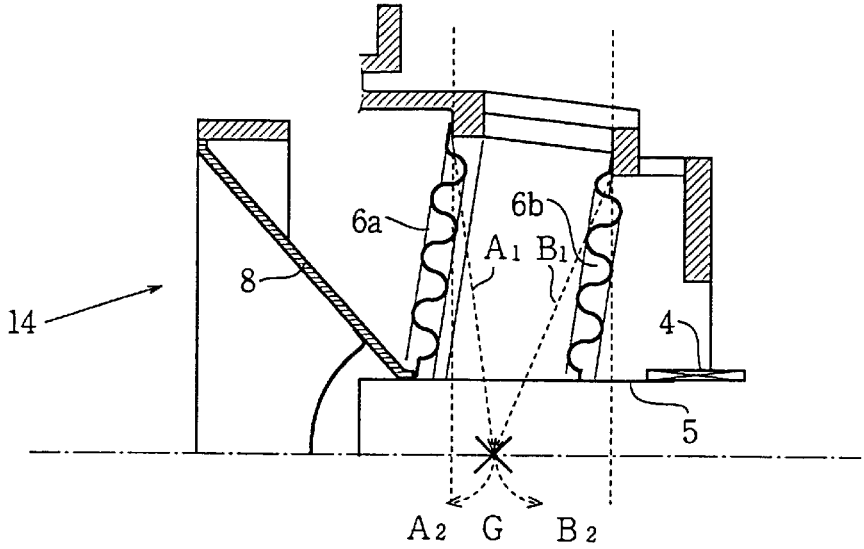
FIGS. 61 and 62 are sectional views of the vibrating systems explaining the operations thereof.

FIG. 61 shows an example of the vibrating system where the center G of gravity thereof is always located at the midpoint of the distance between the dampers 6*a* and 6*b*. Even though the dampers 6*a* and 6*b* are deflected as shown in FIG. 61 when the diaphragm 8 is moved the maximum stroke, the center G of the vibrating system 14 is maintained at the midpoint between dampers. Hence, the moments $A_1$ and $B_1$ of the dampers 6*a* and 6*b*, respectively, are exerted on the center G, generating the moments $A_2$ and $B_2$. The moments $A_2$ and $B_2$ are applied in the opposite directions from each other so as to be canceled. Hence the rolling of the vibration system 14 can be restrained.

Figure 62:
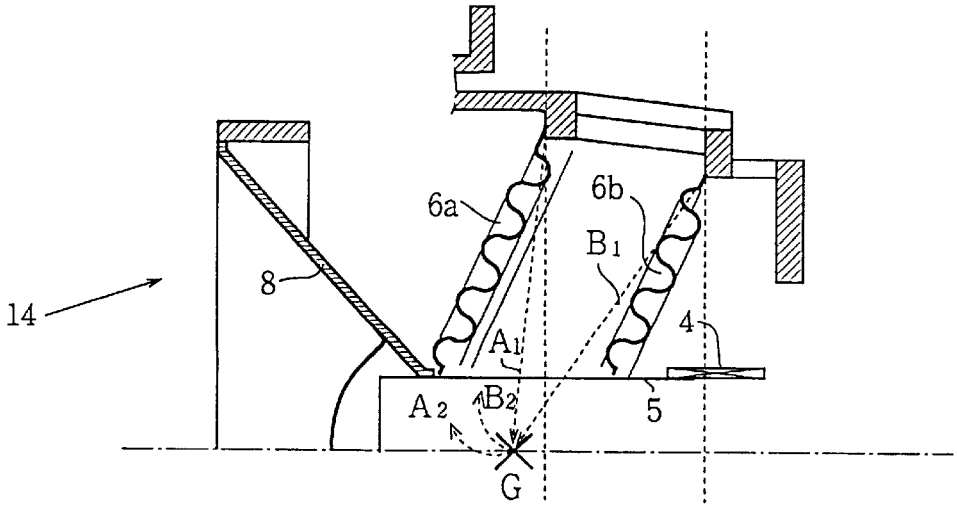

Referring to FIG. 62, if the center G of gravity is deflected from the midpoint at the maximum stroke of the diaphragm 8, the moments $A_1$ and $B_1$ exerted on the center G generates the moments $A_2$ and $B_2$ which are directed in the same direction. The moments $A_2$ and $B_2$ are not canceled so that the rolling of the vibrating system 14 becomes intensified.

The center G of the gravity of the vibrating system 14 can be set at a midpoint of the dampers 6*a* and 6*b* by various means. For example, an appropriate distance between the dampers may be determined, or the compliances of the dampers 6*a* and 6*b* may be changed. The weights of the diaphragm 8 and the voice coil 4 are distributed so as to adjust the position of the center of gravity. Hence the movement of the center G of gravity at operation is restricted.

It goes without saying that the modifications shown in FIGS. 54 to 61 can be applied to loudspeakers provided with the sealing member 11 shown in FIG. 1.

While the invention has been described in conjunction with preferred specific embodiment thereof, it will be understood that this description is intended to illustrate and not limit the scope of the invention, which is defined by the following claims.

What is claimed is:

1. A surroundless loudspeaker system comprising:

a cylindrical frame having a cylindrical supporting portion extending in an axial direction of the loudspeaker system and mounted in a cabinet;

a magnetic circuit provided at a base end of the frame;

a coil bobbin having a voice coil disposed in a magnetic gap of the magnetic circuit;

a diaphragm having a peripheral free edge and connected to the coil bobbin at a central portion thereof;

a cylindrical ring secured to the free edge and disposed in the cylindrical supporting portion of the frame, for increasing acoustic impedance at a gap between the cylindrical ring and the cylindrical supporting portion;

an annular sealing member secured to the cylindrical ring so that an outside peripheral wall thereof is slidably contacted with an inside wall of the cylindrical supporting portion of the frame; and either of the annular sealing member and the inside wall of the supporting portion of the frame being made of a soft material.

2. The speaker system according to claim 1 wherein the annular sealing member has a bent section at an edge portion thereof, and the edge portion is resiliently contacted with the inside wall of the cylindrical supporting portion of the frame.

3. The speaker system according to claim 1 wherein the annular sealing member is made of deformable material, and has a plurality of recesses.

4. The speaker system according to claim 3 wherein the annular sealing member comprises two members overlayed with each other, the recesses of both the members are arranged such that the recesses of one of the members do not overlap with the recesses of the other member.

5. The speaker system according to claim 1 wherein the sealing member is embedded in the cylindrical ring.

6. The speaker system according to claim 1 wherein the sealing member is integral with the cylindrical ring.

7. The speaker system according to claim 1 wherein the sealing member is made of porous material.

8. The speaker system according to claim 7 wherein lubricant is absorbed in pores in the porous material.

9. The speaker system according to claim 1 wherein the sealing member is made of fibrous and porous material.

10. The speaker system according to claim 9 wherein fibers of fibrous material are arranged in the axial direction of the speaker system.

11. The speaker system according to claim 1 wherein the inside wall of the cylindrical supporting portion of the frame is made of material softer than that of the annular sealing member.

12. The speaker system according to claim 1 wherein the inside wall of the cylindrical supporting portion has a plurality of bumps and pits.

13. The speaker system according to claim 1 wherein the inside wall of the cylindrical supporting portion has a plurality of grooves.

14. The speaker system according to claim 1 wherein the inside wall of the cylindrical supporting portion has a plurality of spiral grooves.

15. The speaker system according to claim 1 wherein the inside wall of the cylindrical supporting portion is coated with a lubricant.

16. The speaker system according to claim 1 wherein an outside wall of the annular sealing member is coated with a lubricant.

17. The speaker system according to claim 1 wherein an outside wall of the annular sealing member has a plurality of bumps and pits.

18. The speaker system according to claim 1 wherein the outside wall of the annular sealing member has a plurality of grooves arranged in an axial direction of the loudspeaker system.

19. The speaker system according to claim 1 wherein the cylindrical frame has a cylindrical cover disposed outside thereof and connected with the frame through a connecting flange with a gap there-between.

20. The speaker system according to claim 1 wherein the annular sealing member is secured to the cylindrical ring at an inner position with respect to an axial direction of the ring.

21. The speaker system according to claim 1 wherein the annular sealing member is made of a material of semi-closed cell foam.

22. The speaker system according to claim 1 further comprising damper means provided between the cylindrical supporting portion and the coil bobbin for supporting the coil bobbin.

23. The speaker system according to claim 22 wherein the damper means has an air permeability.

24. The speaker system according to claim 22 wherein the damper means comprises an outer damper and an inner damper.

25. The speaker system according to claim 24 wherein a lead for supplying a current to the voice coil is disposed between the outer and inner dampers.

26. The speaker system according to claim 24 wherein each of the dampers is made of cloth comprising warps and wefts.

27. The speaker system according to claim 24 wherein each of the dampers has a corrugated section.

28. The speaker system according to claim 24 wherein a center of gravity of vibration device comprising the coil bobbin, diaphragm, cylindrical ring and annular sealing member is positioned at an intermediate position between the outer and inner dampers.

29. The speaker system according to claim 22 wherein the damper means is disposed in a plane passing the magnetic gap.

30. The speaker system according to claim 22 wherein the sealing member is disposed in a plane including the damper means.

31. A surroundless loudspeaker system comprising:

a frame having a cylindrical supporting portion extending in an axial direction of the loudspeaker system and mounted in a cabinet;

a magnetic circuit provided at an end of the frame;

a coil bobbin having a voice coil disposed in a magnetic gap of the magnetic circuit;

a diaphragm having a peripheral free edge and connected to the coil bobbin at a central portion thereof;

a cylindrical ring secured to the free edge and disposed in the cylindrical supporting portion of the frame;

an annular sealing member secured to the cylindrical ring so that an outside peripheral wall of the sealing member is slidably contacted with an inside wall of the cylindrical support portion of the frame;

a damper provided between the cylindrical supporting portion and the coil bobbin for supporting the coil bobbin, and for forming a closed space between the diaphragm, the cylindrical ring, the sealing member and the damper;

the damper having an air permeability larger than a predetermined value so as to restrict flow of air in the closed space passing through the damper.

* * * * *

UNITED STATES PATENT AND TRADEMARK OFFICE

CERTIFICATE OF CORRECTION

PATENT NO. : 5,848,173

DATED : December 8, 1998

INVENTOR(S) : Sato, et. al.

It is certified that error appears in the above-identified patent and that said Letters Patent is hereby corrected as shown below:

Title page, item [75], line 1, delete "Ziging" insert --Ziqing--.

Signed and Sealed this

Ninth Day of March, 1999

*Attest:*

*Attesting Officer*

Q. TODD DICKINSON

*Acting Commissioner of Patents and Trademarks*